US010015613B2

(12) United States Patent
Habets et al.

(10) Patent No.: US 10,015,613 B2
(45) Date of Patent: Jul. 3, 2018

(54) SYSTEM, APPARATUS AND METHOD FOR CONSISTENT ACOUSTIC SCENE REPRODUCTION BASED ON ADAPTIVE FUNCTIONS

(71) Applicant: Fraunhofer-Gesellschaft zur Foerderung der angewandten Forschung e.V., Munich (DE)

(72) Inventors: Emanuel Habets, Spardorf (DE); Oliver Thiergart, Erlangen (DE); Konrad Kowalczyk, Nuremburg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/344,076

(22) Filed: Nov. 4, 2016

(65) Prior Publication Data

US 2017/0078819 A1 Mar. 16, 2017

Related U.S. Application Data

(63) Continuation of application No. PCT/EP2015/058857, filed on Apr. 23, 2015.

(30) Foreign Application Priority Data

May 5, 2014 (EP) ..... 14167053
Sep. 5, 2014 (EP) ..... 14183854

(51) Int. Cl.
*H04S 5/00* (2006.01)
*H04S 7/00* (2006.01)
(Continued)

(52) U.S. Cl.
CPC ..... *H04S 5/005* (2013.01); *G10L 19/008* (2013.01); *H04R 25/407* (2013.01); *H04S 7/30* (2013.01);
(Continued)

(58) Field of Classification Search
CPC . H04S 7/50; H04S 5/005; H04S 7/307; H04S 7/303; H04S 2400/11;
(Continued)

(56) References Cited

U.S. PATENT DOCUMENTS 7,583,805 B2 9/2009 Baumgarte et al.
8,180,062 B2 5/2012 Turku et al.
(Continued)

FOREIGN PATENT DOCUMENTS

EP 2346028 A1 7/2011
EP 2418877 A1 2/2012
(Continued)

OTHER PUBLICATIONS

Ahonen, J. et al., "Parametric Spatial Sound Processing Applied to Bilateral Hearing Aids", AES 45th International Conference, Mar. 2012.
(Continued)

*Primary Examiner* — Melur Ramakrishnaiah
(74) *Attorney, Agent, or Firm* — Perkins Coie LLP; Michael A. Glenn

(57) ABSTRACT

A system for generating one or more audio output signals is provided, having a decomposition module, a signal processor, and an output interface. The signal processor is configured to receive the direct component signal, the diffuse component signal and direction information. Moreover, the signal processor is configured to generate one or more processed diffuse signals depending on the diffuse component signal. For each audio output signal of the one or more audio output signals, the signal processor is configured to determine a direct gain, the signal processor is configured to apply the direct gain on the direct component signal to obtain a processed direct signal, and the signal processor is configured to combine the processed direct signal and one of
(Continued)

the one or more processed diffuse signals to generate the audio output signal. The signal processor further has a gain function computation module and a signal modifier.

17 Claims, 17 Drawing Sheets

(51) Int. Cl.
*G10L 19/008* (2013.01)
*H04R 25/00* (2006.01)

(52) U.S. Cl.
CPC ..... *H04S 7/307* (2013.01); *H04R 25/552* (2013.01); *H04S 7/303* (2013.01); *H04S 2400/11* (2013.01); *H04S 2400/13* (2013.01); *H04S 2400/15* (2013.01)

(58) Field of Classification Search
CPC ..... H04S 2400/15; H04S 2400/13; G10L 19/008; H04R 25/407
USPC ..... 381/17–18, 300, 301
See application file for complete search history.

(56) References Cited

U.S. PATENT DOCUMENTS

| | | | | |
|---|---|---|---|---|
| 2006/0206323 | A1 | 9/2006 | Breebaart | |
| 2008/0232601 | A1 | 9/2008 | Pulkki | |
| 2009/0022328 | A1 | 1/2009 | Neugebauer et al. | |
| 2010/0169103 | A1* | 7/2010 | Pulkki | H04S 7/302 704/500 |
| 2013/0016842 | A1* | 1/2013 | Schultz-Amling | G10L 19/173 381/17 |
| 2013/0142341 | A1* | 6/2013 | Del Galdo | G10L 19/008 381/23 |
| 2013/0272526 | A1 | 10/2013 | Walther | |

FOREIGN PATENT DOCUMENTS

| | | | |
|---|---|---|---|
| EP | 2600343 | A1 | 6/2013 |
| JP | 2013514696 | A | 4/2013 |
| RU | 2005103637 | A | 7/2005 |
| RU | 2363116 | C2 | 7/2009 |
| RU | 2416172 | C1 | 4/2011 |
| RU | 2444154 | C2 | 2/2012 |
| WO | 2006014449 | A1 | 2/2006 |
| WO | 2010017967 | A1 | 2/2010 |
| WO | 2011073210 | A1 | 6/2011 |
| WO | 2012033950 | A1 | 3/2012 |

OTHER PUBLICATIONS

Allen, Jont B. et al., "Image Method for Efficiently Simulating Small-RoomAcoustics", Journal of the Acoustical Society of America, vol. 65, No. 4, Apr. 1979, pp. 943-950.

Blauert, J., "Spatial Hearing", Third Edition, Hirzel-Verlag, 2001, 3 pages.

Cook, R.K. et al., "Measurement of Correlation Coefficients in Reverberant Sound Fields", The Journal of the Acoustical Society of America, vol. 27, No. 6, 1955, pp. 1072-1077.

Habets, E.A.P , "Room Impulse Response Generator", [Online] Available: http://home.tiscali.nl/ehabets/rirgenerator.html; see also: http://web.archive.org/web/20120730003147/http://home.tiscali.nl/ehabets/rir_generator.html, Sep. 20, 2010, 21 pages.

Ishigaki, Y. et al., "Zoom Microphone", Audio Engineering Society Convention 67, Paper 1713, Oct. 1980, 35 pages.

Kowalczyk, K. et al., "Sound Acquisition in Noisy and Reverberant Environments Using Virtual Microphones", 2013 IEEE Workshop on Applications of Signal Processing to Audio and Acoustics (WASPAA, Oct. 2013, 4 pages.

Matsumoto, M. et al., "Stereo Zoom Microphone for Consumer Video Cameras", Consumer Electronics, IEEE Transactions, vol. 35, No. 4, Nov. 1989, pp. 759-766.

May, T. et al., "A Probabilistic Model for Robust Localization Based on a Binaural Auditory Front-End", IEEE Transactions on Audio, Speech, Language Processing, vol. 19, No. 1, 2011, pp. 1-13.

Nelisse, H. et al., "Characterization of a Diffuse Field in a Recerberant Room", Journal of the Acoustical Society of America, vol. 101, No. 6, Jun. 1997, 3517-3524.

Pulkki, V et al., "Virtual Sound Source Positioning Using Vector Base Amplitude Panning", Journal of Audio Eng. Soc. vol. 45, No. 6., Jun. 1997, 456-466.

Pulkki, V. , "Spatial Sound Reproduction with Directional Audio Coding", J. Audio Engineering Society, vol. 55, No. 6, Jun. 2007, pp. 503-516.

Rao, B. et al., "Performance Analysis of Root-Music", Twenty-Second Asilomar Conference on Signals, Systems & Computers, Oct. 31-Nov. 2, 1988, pp. 578-582.

Roy, R. et al., "ESPIRIT—Estimation of Signal Parameters Via Rotational Invariance Techniques", IEEE Transactions on Acoustics, Speech, and Signal Processing, vol. 37, No. 7, Jul. 1989, Jul. 1989, pp. 984-995.

Schultz-Amling, R. et al., "Acoustical Zooming Based on a Parametric Sound Field Representation", Audio Engineering Society Convention 128, Paper 8120, London UK, May 2010, pp. 1-9.

Teutsch, H. et al., "An Adaptive Close-Talking Microphone Array", Applications of Signal Processing to Audio and Acoustics, 2001 IEEE Workshop, 2001, pp. 163-166.

Thiergart, O et al., "Sound Examples for an Acoustical Zoom Based on Informed Spatial Filtering", Presented at the International Workshope on Acoustic Signal Enhancement, Online available: http://www.audiolabs-erlangen.de/resources/2014-IWAENC-Zoom/, 2014, 2 pages.

Thiergart, O. et al., "An Informed LCMV Filter Based on Multiple Instantaneous Direction-of-Arrival Estimates", 2013 IEEE International Conference on Acoustics Speech and Signal Processing (ICASSP), Vancouver, BC, Canada., May 2013, pp. 659-663.

Thiergart, O. et al., "Extracting Reverberant Sound Using a Linearly Constrained Minimum Variance Spatial Filter", Signal Processing Letters, IEEE, vol. 21, No. 5, May 2014, pp. 630-634.

Thiergart, O. et al., "Geometry-based Spatial Sound Acquisition Using Distributed Microphone Arrays", IEEE Transactions on Audio, Speech, and Language Processing; vol. 21, No. 12, Dec. 2013, pp. 2583-2594.

Thiergart, O. et al., "On the Spatial Coherence in Mixed Sound Fields and its Application to Signal-to-Diffuse Ratio Estimation", The Journal of the Acoustical Society of America; vol. 132; No. 4, Oct. 2012, pp. 2337-2346.

Van Waterschoot, T. et al., "Acoustic Zooming by Multi Microphone Sound Scene Manipulation", J. Audio Engineering Society, vol. 61, No. 7/8, 2013, pp. 489-807.

Pulkki, Ville, "Directional Audio Coding in Spatial Sound Reproduction and Stereo Upmixing", 28th International Conference, U.S.A., Audio Engineering Society, [Online], [Search Date Dec. 26, 2017], Internet: <URL: http://aes.org/e-lib/browse.cfm?elib=13847>, Jun. 1, 2006, 1-7.

* cited by examiner panning function after zooming with a shift window function after zooming with a shift time-delay of the repeated direct sound

SYSTEM, APPARATUS AND METHOD FOR CONSISTENT ACOUSTIC SCENE REPRODUCTION BASED ON ADAPTIVE FUNCTIONS

CROSS-REFERENCE TO RELATED APPLICATIONS

This application is a continuation of copending International Application No. PCT/EP2015/058857, filed Apr. 23, 2015, which is incorporated herein by reference in its entirety, and additionally claims priority from European Application No. 14167053.9, filed May 5, 2014, and from European Application No. 14183854.0, filed Sep. 5, 2014, which are also incorporated herein by reference in their entirety.

BACKGROUND OF THE INVENTION

The present invention relates to audio signal processing, and, in particular, to a system, an apparatus and a method for consistent acoustic scene reproduction based on informed spatial filtering.

In spatial sound reproduction the sound at the recording location (near-end side) is captured with multiple microphones and then reproduced at the reproduction side (far-end side) using multiple loudspeakers or headphones. In many applications, it is desired to reproduce the recorded sound such that the spatial image recreated at the far-end side is consistent with the original spatial image at the near-end side. This means for instance that the sound of the sound sources is reproduced from the directions where the sources were present in the original recording scenario. Alternatively, when for instance a video is complimenting the recorded audio, it is desirable that the sound is reproduced such that the recreated acoustical image is consistent with the video image. This means for instance that the sound of a sound source is reproduced from the direction where the source is visible in the video. Additionally, the video camera may be equipped with a visual zoom function or the user at the far-end side may apply a digital zoom to the video which would change the visual image. In this case, the acoustical image of the reproduced spatial sound should change accordingly. In many cases, the far-end side determines the spatial image to which the reproduced sound should be consistent is determined either at the far end side or during play back, for instance when a video image is involved. Consequently, the spatial sound at the near-end side is recorded, processed, and transmitted such that at the far-end side we can still control the recreated acoustical image.

The possibility to reproduce a recorded acoustical scene consistently with a desired spatial image is necessitated in many modern applications. For instance modern consumer devices such as digital cameras or mobile phones are often equipped with a video camera and multiple microphones. This enables to record videos together with spatial sound, e.g., stereo sound. When reproducing the recorded audio together with the video, it is desired that the visual and acoustical image are consistent. When the user zooms in with the camera, it is desirable to recreate the visual zooming effect acoustically so that the visual and acoustical images are aligned when watching the video. For instance, when the user zooms in on a person, the voice of this person should become less reverberant as the person appears to be closer to the camera. Moreover, the voice of the person should be reproduced from the same direction where the person appears in the visual image. Mimicking the visual zoom of a camera acoustically is referred to as acoustical zoom in the following and represents one example of a consistent audio-video reproduction. The consistent audio-video reproduction which may involve an acoustical zoom is also useful in teleconferencing, where the spatial sound at the near-end side is reproduced at the far-end side together with a visual image. Moreover, it is desirable to recreate the visual zooming effect acoustically so that the visual and acoustical images are aligned.

The first implementation of an acoustical zoom was presented in [1], where the zooming effect was obtained by increasing the directivity of a second-order directional microphone, whose signal was generated based on the signals of a linear microphone array. This approach was extended in [2] to a stereo zoom. A more recent approach for a mono or stereo zoom was presented in [3], which consists in changing the sound source levels such that the source from the frontal direction was preserved, whereas the sources coming from other directions and the diffuse sound were attenuated. The approaches proposed in [1,2] result in an increase of the direct-to-reverberation ratio (DRR) and the approach in [3] additionally allows for the suppression of undesired sources. The aforementioned approaches assume the sound source is located in front of a camera, and do not aim to capture the acoustical image that is consistent with the video image.

A well-known approach for a flexible spatial sound recording and reproduction is represented by directional audio coding (DirAC) [4]. In DirAC, the spatial sound at the near-end side is described in terms of an audio signal and parametric side information, namely the direction-of-arrival (DOA) and diffuseness of the sound. The parametric description enables the reproduction of the original spatial image with arbitrary loudspeaker setups. This means that the recreated spatial image at the far-end side is consistent with the spatial image during recording at the near-end side. However, if for instance a video is complimenting the recorded audio, then the reproduced spatial sound is not necessarily aligned to the video image. Moreover, the recreated acoustical image cannot be adjusted when the visual images changes, e.g., when the look direction and zoom of the camera is changed. This means that DirAC provides no possibility to adjust the recreated acoustical image to an arbitrary desired spatial image.

In [5], an acoustical zoom was realized based on DirAC. DirAC represents a reasonable basis to realize an acoustical zoom as it is based on a simple yet powerful signal model assuming that the sound field in the time-frequency domain is composed of a single plane wave plus diffuse sound. The underlying model parameters, e.g., the DOA and diffuseness, are exploited to separate the direct sound and diffuse sound and to create the acoustical zoom effect. The parametric description of the spatial sound enables an efficient transmission of the sound scene to the far-end side while still providing the user full control over the zoom effect and spatial sound reproduction. Even though DirAC employs multiple microphones to estimate the model parameters, only single-channel filters are applied to extract the direct sound and diffuse sound, limiting the quality of the reproduced sound. Moreover, all sources in the sound scene are assumed to be positioned on a circle and the spatial sound reproduction is performed with reference to a changing position of an audio-visual camera, which is inconsistent with the visual zoom. In fact, zooming changes the view angle of the camera while the distance to the visual objects and their relative positions in the image remain unchanged, which is in contrast to moving a camera.

A related approach is the so-called virtual microphone (VM) technique [6,7] which considers the same signal model as DirAC but allows to synthesize the signal of a non-existing (virtual) microphone in an arbitrary position in the sound scene. Moving the VM towards a sound source is analogous to the movement of the camera to a new position. The VM was realized using multi-channel filters to improve the sound quality, but necessitates several distributed microphone arrays to estimate the model parameters.

However, it would be highly appreciated, if further improved concepts for audio signal processing would be provided.

SUMMARY

According to an embodiment, an apparatus for generating one or more audio output signals may have: a signal processor, and an output interface, wherein the signal processor is configured to receive a direct component signal, having direct signal components of two or more original audio signals, wherein the signal processor is configured to receive a diffuse component signal, having diffuse signal components of the two or more original audio signals, and wherein the signal processor is configured to receive direction information, said direction information depending on a direction of arrival of the direct signal components of the two or more original audio signals, wherein the signal processor is configured to generate one or more processed diffuse signals depending on the diffuse component signal, wherein, for each audio output signal of the one or more audio output signals, the signal processor is configured to determine, depending on the direction of arrival, a direct gain being a gain value, the signal processor is configured to apply said direct gain on the direct component signal to obtain a processed direct signal, and the signal processor is configured to combine said processed direct signal and one of the one or more processed diffuse signals to generate said audio output signal, and wherein the output interface is configured to output the one or more audio output signals, wherein the signal processor has a gain function computation module for calculating one or more gain functions, wherein each gain function of the one or more gain functions, has a plurality of gain function argument values, wherein a gain function return value is assigned to each of said gain function argument values, wherein, when said gain function receives one of said gain function argument values, said gain function is configured to return the gain function return value being assigned to said one of said gain function argument values, and wherein the signal processor further has a signal modifier for selecting, depending on the direction of arrival, a direction dependent argument value from the gain function argument values of a gain function of the one or more gain functions, for obtaining the gain function return value being assigned to said direction dependent argument value from said gain function, and for determining the gain value of at least one of the one or more audio output signals depending on said gain function return value obtained from said gain function.

According to another embodiment, a system for generating one or more audio output signals may have: the above apparatus for generating one or more audio output signals, and a decomposition module, wherein the decomposition module is configured to receive two or more audio input signals being the two or more original audio signals, wherein the decomposition module is configured to generate the direct component signal, having the direct signal components of the two or more original audio signals, and wherein the decomposition module is configured to generate the diffuse component signal, having the diffuse signal components of the two or more original audio signals.

According to another embodiment, a method for generating one or more audio output signals may have the steps of: receiving a direct component signal, having direct signal components of two or more original audio signals, receiving a diffuse component signal, having diffuse signal components of the two or more original audio signals, receiving direction information, said direction information depending on a direction of arrival of the direct signal components of the two or more original audio signals, generating one or more processed diffuse signals depending on the diffuse component signal, for each audio output signal of the one or more audio output signals, determining, depending on the direction of arrival, a direct gain, applying said direct gain on the direct component signal to obtain a processed direct signal, and the combining said processed direct signal and one of the one or more processed diffuse signals to generate said audio output signal, and outputting the one or more audio output signals, wherein generating the one or more audio output signals has calculating one or more gain functions, wherein each gain function of the one or more gain functions, has a plurality of gain function argument values, wherein a gain function return value is assigned to each of said gain function argument values, wherein, when said gain function receives one of said gain function argument values, wherein said gain function is configured to return the gain function return value being assigned to said one of said gain function argument values, and wherein generating the one or more audio output signals has selecting, depending on the direction of arrival, a direction dependent argument value from the gain function argument values of a gain function of the one or more gain functions, for obtaining the gain function return value being assigned to said direction dependent argument value from said gain function, and for determining the gain value of at least one of the one or more audio output signals depending on said gain function return value obtained from said gain function.

Another embodiment may have a computer program for implementing a method for generating one or more audio output signals having the steps of: receiving a direct component signal, having direct signal components of two or more original audio signals, receiving a diffuse component signal, having diffuse signal components of the two or more original audio signals, receiving direction information, said direction information depending on a direction of arrival of the direct signal components of the two or more original audio signals, generating one or more processed diffuse signals depending on the diffuse component signal, for each audio output signal of the one or more audio output signals, determining, depending on the direction of arrival, a direct gain, applying said direct gain on the direct component signal to obtain a processed direct signal, and the combining said processed direct signal and one of the one or more processed diffuse signals to generate said audio output signal, and outputting the one or more audio output signals, wherein generating the one or more audio output signals has calculating one or more gain functions, wherein each gain function of the one or more gain functions, has a plurality of gain function argument values, wherein a gain function return value is assigned to each of said gain function argument values, wherein, when said gain function receives one of said gain function argument values, wherein said gain function is configured to return the gain function return value being assigned to said one of said gain function argument values, and wherein generating the one or more audio output signals has selecting, depending on the direction of arrival, a direction dependent argument value from the gain function argument values of a gain function of the one or more gain functions, for obtaining the gain function return value being assigned to said direction dependent argument value from said gain function, and for determining the gain value of at least one of the one or more audio output signals depending on said gain function return value obtained from said gain function, when being executed on a computer or signal processor.

A system for generating one or more audio output signals is provided. The system comprises a decomposition module, a signal processor, and an output interface. The decomposition module is configured to receive two or more audio input signals, wherein the decomposition module is configured to generate a direct component signal, comprising direct signal components of the two or more audio input signals, and wherein the decomposition module is configured to generate a diffuse component signal, comprising diffuse signal components of the two or more audio input signals. The signal processor is configured to receive the direct component signal, the diffuse component signal and direction information, said direction information depending on a direction of arrival of the direct signal components of the two or more audio input signals. Moreover, the signal processor is configured to generate one or more processed diffuse signals depending on the defuse component signal. For each audio output signal of the one or more audio output signals, the signal processor is configured to determine, depending on the direction of arrival, a direct gain, the signal processor is configured to apply said direct gain on the direct component signal to obtain a processed direct signal, and the signal processor is configured to combine said processed direct signal and one of the one or more processed diffuse signals to generate said audio output signal. The output interface is configured to output the one or more audio output signals. The signal processor comprises a gain function computation module for calculating one or more gain functions, wherein each gain function of the one or more gain functions, comprises a plurality of gain function argument values, wherein a gain function return value is assigned to each of said gain function argument values, wherein, when said gain function receives one of said gain function argument values, wherein said gain function is configured to return the gain function return value being assigned to said one of said gain function argument values.

Moreover, the signal processor further comprises a signal modifier for selecting, depending on the direction of arrival, a direction dependent argument value from the gain function argument values of a gain function of the one or more gain functions, for obtaining the gain function return value being assigned to said direction dependent argument value from said gain function, and for determining the gain value of at least one of the one or more audio output signals depending on said gain function return value obtained from said gain function.

According to an embodiment, the gain function computation module may, e.g., be configured to generate a lookup table for each gain function of the one or more gain functions, wherein the lookup table comprises a plurality of entries, wherein each of the entries of the lookup table comprises one of the gain function argument values and the gain function return value being assigned to said gain function argument value, wherein the gain function computation module may, e.g., be configured to store the lookup table of each gain function in persistent or non-persistent memory, and wherein the signal modifier may, e.g., be configured to obtain the gain function return value being assigned to said direction dependent argument value by reading out said gain function return value from one of the one or more lookup tables being stored in the memory.

In an embodiment, the signal processor may, e.g., be configured to determine two or more audio output signals, wherein the gain function computation module may, e.g., be configured to calculate two or more gain functions, wherein, for each audio output signal of the two or more audio output signals, the gain function computation module may, e.g., be configured to calculate a panning gain function being assigned to said audio output signal as one of the two or more gain functions, wherein the signal modifier may, e.g., be configured to generate said audio output signal depending on said panning gain function.

According to an embodiment, the panning gain function of each of the two or more audio output signals may, e.g., have one or more global maxima, being one of the gain function argument values of said panning gain function, wherein for each of the one or more global maxima of said panning gain function, no other gain function argument value exists for which said panning gain function returns a greater gain function return value than for said global maxima, and wherein, for each pair of a first audio output signal and a second audio output signal of the two or more audio output signals, at least one of the one or more global maxima of the panning gain function of the first audio output signal may, e.g., be different from any of the one or more global maxima of the panning gain function of the second audio output signal.

According to an embodiment, for each audio output signal of the two or more audio output signals, the gain function computation module may, e.g., be configured to calculate a window gain function being assigned to said audio output signal as one of the two or more gain functions, wherein the signal modifier may, e.g., be configured to generate said audio output signal depending on said window gain function, and wherein, if the argument value of said window gain function is greater than a lower window threshold and smaller than an upper window threshold, the window gain function is configured to return a gain function return value being greater than any gain function return value returned by said window gain function, if the window function argument value is smaller than the lower threshold, or greater than the upper threshold.

In an embodiment, the window gain function of each of the two or more audio output signals has one or more global maxima, being one of the gain function argument values of said window gain function, wherein for each of the one or more global maxima of said window gain function, no other gain function argument value exists for which said window gain function returns a greater gain function return value than for said global maxima, and wherein, for each pair of a first audio output signal and a second audio output signal of the two or more audio output signals, at least one of the one or more global maxima of the window gain function of the first audio output signal may, e.g., be equal to one of the one or more global maxima of the window gain function of the second audio output signal.

According to an embodiment, the gain function computation module may, e.g., be configured to further receive orientation information indicating an angular shift of a look direction with respect to the direction of arrival, and wherein the gain function computation module may, e.g., be configured to generate the panning gain function of each of the audio output signals depending on the orientation information.

In an embodiment, the gain function computation module may, e.g., be configured to generate the window gain function of each of the audio output signals depending on the orientation information.

According to an embodiment, the gain function computation module may, e.g., be configured to further receive zoom information, wherein the zoom information indicates an opening angle of a camera, and wherein the gain function computation module may, e.g., be configured to generate the panning gain function of each of the audio output signals depending on the zoom information.

In an embodiment, the gain function computation module may, e.g., be configured to generate the window gain function of each of the audio output signals depending on the zoom information.

According to an embodiment, the gain function computation module may, e.g., be configured to further receive a calibration parameter for aligning a visual image and an acoustical image, and wherein the gain function computation module may, e.g., be configured to generate the panning gain function of each of the audio output signals depending on the calibration parameter.

In an embodiment, the gain function computation module may, e.g., be configured to generate the window gain function of each of the audio output signals depending on the calibration parameter.

A system according to one of the preceding claims, the gain function computation module may, e.g., be configured to receive information on a visual image, and the gain function computation module may, e.g., be configured to generate, depending on the information on a visual image, a blurring function returning complex gains to realize perceptual spreading of a sound source.

Moreover, an apparatus for generating one or more audio output signals is provided. The apparatus comprises a signal processor and an output interface. The signal processor is configured to receive a direct component signal, comprising direct signal components of the two or more original audio signals, wherein the signal processor is configured to receive a diffuse component signal, comprising diffuse signal components of the two or more original audio signals, and wherein the signal processor is configured to receive direction information, said direction information depending on a direction of arrival of the direct signal components of the two or more audio input signals. Moreover, the signal processor is configured to generate one or more processed diffuse signals depending on the defuse component signal. For each audio output signal of the one or more audio output signals, the signal processor is configured to determine, depending on the direction of arrival, a direct gain, the signal processor is configured to apply said direct gain on the direct component signal to obtain a processed direct signal, and the signal processor is configured to combine said processed direct signal and one of the one or more processed diffuse signals to generate said audio output signal. The output interface is configured to output the one or more audio output signals. The signal processor comprises a gain function computation module for calculating one or more gain functions, wherein each gain function of the one or more gain functions, comprises a plurality of gain function argument values, wherein a gain function return value is assigned to each of said gain function argument values, wherein, when said gain function receives one of said gain function argument values, wherein said gain function is configured to return the gain function return value being assigned to said one of said gain function argument values. Moreover, the signal processor further comprises a signal modifier for selecting, depending on the direction of arrival, a direction dependent argument value from the gain function argument values of a gain function of the one or more gain functions, for obtaining the gain function return value being assigned to said direction dependent argument value from said gain function, and for determining the gain value of at least one of the one or more audio output signals depending on said gain function return value obtained from said gain function.

Furthermore, a method for generating one or more audio output signals is provided. The method comprises:

Receiving two or more audio input signals.

Generating a direct component signal, comprising direct signal components of the two or more audio input signals.

Generating a diffuse component signal, comprising diffuse signal components of the two or more audio input signals.

Receiving direction information depending on a direction of arrival of the direct signal components of the two or more audio input signals.

Generating one or more processed diffuse signals depending on the defuse component signal.

For each audio output signal of the one or more audio output signals, determining, depending on the direction of arrival, a direct gain, applying said direct gain on the direct component signal to obtain a processed direct signal, and combining said processed direct signal and one of the one or more processed diffuse signals to generate said audio output signal. And:

Outputting the one or more audio output signals.

Generating the one or more audio output signals comprises calculating one or more gain functions, wherein each gain function of the one or more gain functions, comprises a plurality of gain function argument values, wherein a gain function return value is assigned to each of said gain function argument values, wherein, when said gain function receives one of said gain function argument values, wherein said gain function is configured to return the gain function return value being assigned to said one of said gain function argument values. Moreover, generating the one or more audio output signals comprises selecting, depending on the direction of arrival, a direction dependent argument value from the gain function argument values of a gain function of the one or more gain functions, for obtaining the gain function return value being assigned to said direction dependent argument value from said gain function, and for determining the gain value of at least one of the one or more audio output signals depending on said gain function return value obtained from said gain function.

Moreover, a method for generating one or more audio output signals is provided. The method comprises:

Receiving a direct component signal, comprising direct signal components of the two or more original audio signals.

Receiving a diffuse component signal, comprising diffuse signal components of the two or more original audio signals.

Receiving direction information, said direction information depending on a direction of arrival of the direct signal components of the two or more audio input signals.

Generating one or more processed diffuse signals depending on the defuse component signal.

For each audio output signal of the one or more audio output signals, determining, depending on the direction of arrival, a direct gain, applying said direct gain on the direct component signal to obtain a processed direct signal, and the combining said processed direct signal and one of the one or more processed diffuse signals to generate said audio output signal. And:

Outputting the one or more audio output signals.

Generating the one or more audio output signals comprises calculating one or more gain functions, wherein each gain function of the one or more gain functions, comprises a plurality of gain function argument values, wherein a gain function return value is assigned to each of said gain function argument values, wherein, when said gain function receives one of said gain function argument values, wherein said gain function is configured to return the gain function return value being assigned to said one of said gain function argument values. Moreover, generating the one or more audio output signals comprises selecting, depending on the direction of arrival, a direction dependent argument value from the gain function argument values of a gain function of the one or more gain functions, for obtaining the gain function return value being assigned to said direction dependent argument value from said gain function, and for determining the gain value of at least one of the one or more audio output signals depending on said gain function return value obtained from said gain function.

Moreover, computer programs are provided, wherein each of the computer programs is configured to implement one of the above-described methods when being executed on a computer or signal processor, so that each of the above-described methods is implemented by one of the computer programs.

Furthermore, a system for generating one or more audio output signals is provided. The system comprises a decomposition module, a signal processor, and an output interface. The decomposition module is configured to receive two or more audio input signals, wherein the decomposition module is configured to generate a direct component signal, comprising direct signal components of the two or more audio input signals, and wherein the decomposition module is configured to generate a diffuse component signal, comprising diffuse signal components of the two or more audio input signals. The signal processor is configured to receive the direct component signal, the diffuse component signal and direction information, said direction information depending on a direction of arrival of the direct signal components of the two or more audio input signals. Moreover, the signal processor is configured to generate one or more processed diffuse signals depending on the defuse component signal. For each audio output signal of the one or more audio output signals, the signal processor is configured to determine, depending on the direction of arrival, a direct gain, the signal processor is configured to apply said direct gain on the direct component signal to obtain a processed direct signal, and the signal processor is configured to combine said processed direct signal and one of the one or more processed diffuse signals to generate said audio output signal. The output interface is configured to output the one or more audio output signals.

According to embodiments, concepts are provided to achieve spatial sound recording and reproduction such that the recreated acoustical image may, e.g., be consistent to a desired spatial image, which is, for example, determined by the user at the far-end side or by a video-image. The proposed approach uses a microphone array at the near-end side which allows us to decompose the captured sound into direct sound components and a diffuse sound component. The extracted sound components are then transmitted to the far-end side. The consistent spatial sound reproduction may, e.g., be realized by a weighted sum of the extracted direct sound and diffuse sound, where the weights depend on the desired spatial image to which the reproduced sound should be consistent, e.g., the weights depend on the look direction and zooming factor of the video camera, which may, e.g., be complimenting the audio recording. Concepts are provided which employ informed multi-channel filters for the extraction of the direct sound and diffuse sound.

According to an embodiment, the signal processor may, e.g., be configured to determine two or more audio output signals, wherein for each audio output signal of the two or more audio output signals a panning gain function may, e.g., be assigned to said audio output signal, wherein the panning gain function of each of the two or more audio output signals comprises a plurality of panning function argument values, wherein a panning function return value may, e.g., be assigned to each of said panning function argument values, wherein, when said panning gain function receives one of said panning function argument values, said panning gain function may, e.g., be configured to return the panning function return value being assigned to said one of said panning function argument values, and wherein the signal processor may, e.g., be configured to determine each of the two or more audio output signals depending on a direction dependent argument value of the panning function argument values of the panning gain function being assigned to said audio output signal, wherein said direction dependent argument value depends on the direction of arrival.

In an embodiment, the panning gain function of each of the two or more audio output signals has one or more global maxima, being one of the panning function argument values, wherein for each of the one or more global maxima of each panning gain function, no other panning function argument value exists for which said panning gain function returns a greater panning function return value than for said global maxima, and wherein, for each pair of a first audio output signal and a second audio output signal of the two or more audio output signals, at least one of the one or more global maxima of the panning gain function of the first audio output signal may, e.g., be different from any of the one or more global maxima of the panning gain function of the second audio output signal.

According to an embodiment, the signal processor may, e.g., be configured to generate each audio output signal of the one or more audio output signals depending on a window gain function, wherein the window gain function may, e.g., be configured to return a window function return value when receiving a window function argument value, wherein, if the window function argument value may, e.g., be greater than a lower window threshold and smaller than an upper window threshold, the window gain function may, e.g., be configured to return a window function return value being greater than any window function return value returned by the window gain function, if the window function argument value may, e.g., be smaller than the lower threshold, or greater than the upper threshold.

In an embodiment, the signal processor may, e.g., be configured to further receive orientation information indicating an angular shift of a look direction with respect to the direction of arrival, and wherein at least one of the panning gain function and the window gain function depends on the orientation information; or wherein the gain function computation module may, e.g., be configured to further receive zoom information, wherein the zoom information indicates an opening angle of a camera, and wherein at least one of the panning gain function and the window gain function depends on the zoom information; or wherein the gain function computation module may, e.g., be configured to further receive a calibration parameter, and wherein at least one of the panning gain function and the window gain function depends on the calibration parameter.

According to an embodiment, the signal processor may, e.g., be configured to receive distance information, wherein the signal processor may, e.g., be configured to generate each audio output signal of the one or more audio output signals depending on the distance information.

According to an embodiment, the signal processor may, e.g., be configured to receive an original angle value depending on an original direction of arrival, being the direction of arrival of the direct signal components of the two or more audio input signals, and may, e.g., be configured to receive the distance information, wherein the signal processor may, e.g., be configured to calculate a modified angle value depending on the original angle value and depending on the distance information, and wherein the signal processor may, e.g., be configured to generate each audio output signal of the one or more audio output signals depending on the modified angle value.

According to an embodiment, the signal processor may, e.g., be configured to generate the one or more audio output signals by conducting low pass filtering, or by adding delayed direct sound, or by conducting direct sound attenuation, or by conducting temporal smoothing, or by conducting direction of arrival spreading, or by conducting decorrelation.

In an embodiment, the signal processor may, e.g., be configured to generate two or more audio output channels, wherein the signal processor may, e.g., be configured to apply the diffuse gain on the diffuse component signal to obtain an intermediate diffuse signal, and wherein the signal processor may, e.g., be configured to generate one or more decorrelated signals from the intermediate diffuse signal by conducting decorrelation, wherein the one or more decorrelated signals form the one or more processed diffuse signals, or wherein the intermediate diffuse signal and the one or more decorrelated signals form the one or more processed diffuse signals.

According to an embodiment, the direct component signal and one or more further direct component signals form a group of two or more direct component signals, wherein the decomposition module may, e.g., be configured may, e.g., be configured to generate the one or more further direct component signals comprising further direct signal components of the two or more audio input signals, wherein the direction of arrival and one or more further direction of arrivals form a group of two or more direction of arrivals, wherein each direction of arrival of the group of the two or more direction of arrivals may, e.g., be assigned to exactly one direct component signal of the group of the two or more direct component signals, wherein the number of the direct component signals of the two or more direct component signals and the number of the direction of arrivals of the two direction of arrivals may, e.g., be equal, wherein the signal processor may, e.g., be configured to receive the group of the two or more direct component signals, and the group of the two or more direction of arrivals, and wherein, for each audio output signal of the one or more audio output signals, the signal processor may, e.g., be configured to determine, for each direct component signal of the group of the two or more direct component signals, a direct gain depending on the direction of arrival of said direct component signal, the signal processor may, e.g., be configured to generate a group of two or more processed direct signals by applying, for each direct component signal of the group of the two or more direct component signals, the direct gain of said direct component signal on said direct component signal, and the signal processor may, e.g., be configured to combine one of the one or more processed diffuse signals and each processed signal of the group of the two or more processed signals to generate said audio output signal.

In an embodiment, the number of the direct component signals of the group of the two or more direct component signals plus 1 may, e.g., be smaller than the number of the audio input signals being received by the receiving interface.

Moreover, a hearing aid or an assistive listening device comprising a system as described above may, e.g., be provided.

Moreover, an apparatus for generating one or more audio output signals is provided. The apparatus comprises a signal processor and an output interface. The signal processor is configured to receive a direct component signal, comprising direct signal components of the two or more original audio signals, wherein the signal processor is configured to receive a diffuse component signal, comprising diffuse signal components of the two or more original audio signals, and wherein the signal processor is configured to receive direction information, said direction information depending on a direction of arrival of the direct signal components of the two or more audio input signals. Moreover, the signal processor is configured to generate one or more processed diffuse signals depending on the defuse component signal. For each audio output signal of the one or more audio output signals, the signal processor is configured to determine, depending on the direction of arrival, a direct gain, the signal processor is configured to apply said direct gain on the direct component signal to obtain a processed direct signal, and the signal processor is configured to combine said processed direct signal and one of the one or more processed diffuse signals to generate said audio output signal. The output interface is configured to output the one or more audio output signals.

Furthermore, a method for generating one or more audio output signals is provided. The method comprises:

Receiving two or more audio input signals.

Generating a direct component signal, comprising direct signal components of the two or more audio input signals.

Generating a diffuse component signal, comprising diffuse signal components of the two or more audio input signals.

Receiving direction information depending on a direction of arrival of the direct signal components of the two or more audio input signals.

Generating one or more processed diffuse signals depending on the defuse component signal.

For each audio output signal of the one or more audio output signals, determining, depending on the direction of arrival, a direct gain, applying said direct gain on the direct component signal to obtain a processed direct signal, and combining said processed direct signal and one of the one or more processed diffuse signals to generate said audio output signal. And:

Outputting the one or more audio output signals.

Moreover, a method for generating one or more audio output signals is provided. The method comprises:

Receiving a direct component signal, comprising direct signal components of the two or more original audio signals.

Receiving a diffuse component signal, comprising diffuse signal components of the two or more original audio signals.

Receiving direction information, said direction information depending on a direction of arrival of the direct signal components of the two or more audio input signals.

Generating one or more processed diffuse signals depending on the defuse component signal.

For each audio output signal of the one or more audio output signals, determining, depending on the direction of arrival, a direct gain, applying said direct gain on the direct component signal to obtain a processed direct signal, and the combining said processed direct signal and one of the one or more processed diffuse signals to generate said audio output signal. And:

Outputting the one or more audio output signals.

Moreover, computer programs are provided, wherein each of the computer programs is configured to implement one of the above-described methods when being executed on a computer or signal processor, so that each of the above-described methods is implemented by one of the computer programs.

BRIEF DESCRIPTION OF THE DRAWINGS

Embodiments of the present invention will be described below in more detail with reference to the figures, in which.

DETAILED DESCRIPTION OF THE INVENTION

Figure 1A:
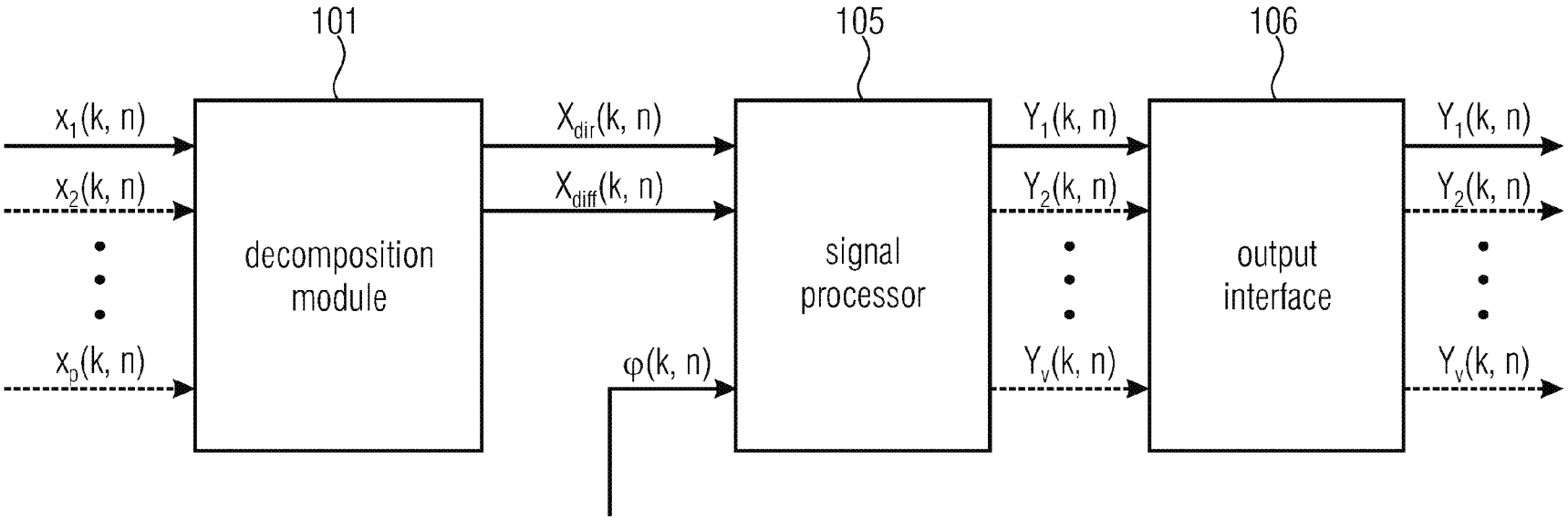
FIG. 1*a* illustrates a system according to an embodiment.

FIG. 1*a* illustrates a system for generating one or more audio output signals is provided. The system comprises a decomposition module 101, a signal processor 105, and an output interface 106.

The decomposition module 101 is configured to generate a direct component signal $X_{dir}(k, n)$, comprising direct signal components of the two or more audio input signals $x_1(k, n), x_2(k, n), \ldots x_p(k, n)$. Moreover, the decomposition module 101 is configured to generate a diffuse component signal $X_{diff}(k, n)$, comprising diffuse signal components of the two or more audio input signals $x_1(k, n), x_2(k, n), \ldots x_p(k, n)$.

The signal processor 105 is configured to receive the direct component signal $X_{dir}(k, n)$, the diffuse component signal $X_{diff}(k, n)$ and direction information, said direction information depending on a direction of arrival of the direct signal components of the two or more audio input signals $x_1(k, n), x_2(k, n), \ldots x_p(k, n)$.

Moreover, the signal processor 105 is configured to generate one or more processed diffuse signals $Y_{diff,1}(k, n)$, $Y_{diff,2}(k, n), \ldots, Y_{diff,v}(k, n)$ depending on the defuse component signal $X_{diff}(k, n)$.

For each audio output signal $Y_i(k, n)$ of the one or more audio output signals $Y_1(k, n), Y_2(k, n), \ldots, Y_v(k, n)$, the signal processor 105 is configured to determine, depending on the direction of arrival, a direct gain $G_i(k, n)$, the signal processor 105 is configured to apply said direct gain $G_i(k, n)$ on the direct component signal $X_{dir}(k, n)$ to obtain a processed direct signal $Y_{dir,i}(k, n)$, and the signal processor 105 is configured to combine said processed direct signal $Y_{dir,i}(k, n)$ and one $Y_{diff,i}(k, n)$ of the one or more processed diffuse signals $Y_{diff,1}(k, n), Y_{diff,2}(k, n), \ldots, Y_{diff,v}(k, n)$ to generate said audio output signal $Y_i(k, n)$.

The output interface 106 is configured to output the one or more audio output signals $Y_1(k, n), Y_2(k, n), \ldots, Y_v(k, n)$.

As outlined, the direction information depends on a direction of arrival $\varphi(k, n)$ of the direct signal components of the two or more audio input signals $x_1(k, n), x_2(k, n), \ldots x_p(k, n)$. For example, the direction of arrival of the direct signal components of the two or more audio input signals $x_1(k, n), x_2(k, n), \ldots x_p(k, n)$ may, e.g., itself be the direction information. Or, for example, the direction information, may, for example, be the propagation direction of the direct signal components of the two or more audio input signals $x_1(k, n), x_2(k, n), \ldots x_p(k, n)$. While the direction of arrival points from a receiving microphone array to a sound source, the propagation direction points from the sound source to the receiving microphone array. Thus, the propagation direction points in exactly the opposite direction of the direction of arrival and therefore depends on the direction of arrival.

To generate one $Y_i(k, n)$ of the one or more audio output signals $Y_1(k, n), Y_2(k, n), \ldots, Y_v(k, n)$, the signal processor 105 determines, depending on the direction of arrival, a direct gain $G_i(k, n)$, apply said direct gain $G_i(k, n)$ on the direct component signal $X_{dir}(k, n)$ to obtain a processed direct signal $Y_{dir,i}(k, n)$, and combine said processed direct signal $Y_{dir,i}(k, n)$ and one $Y_{diff,i}(k, n)$ of the one or more processed diffuse signals $Y_{diff,1}(k, n), Y_{diff,2}(k, n), \ldots, Y_{diff,v}(k, n)$ to generate said audio output signal $Y_i(k, n)$ This is done for each of the one or more audio output signals $Y_1(k, n), Y_2(k, n), \ldots, Y_v(k, n)$ that shall be generated $Y_1(k, n), Y_2(k, n), \ldots, Y_v(k, n)$. The signal processor may, for example, be configured to generate one, two, three or more audio output signals $Y_1(k, n)$, $Y_2(k, n), \ldots, Y_v(k, n)$.

Regarding the one or more processed diffuse signals $Y_{diff,i}(k, n), Y_{diff,2}(k, n), \ldots, Y_{diff,v}(k, n)$, according to an embodiment, the signal processor 105 may, for example, be configured to generate the one or more processed diffuse signals $Y_{diff,1}(k, n), Y_{diff,2}(k, n), \ldots, Y_{diff,v}(k, n)$ by applying a diffuse gain Q(k, n) on the diffuse component signal $X_{diff}(k, n)$.

The decomposition module 101 is configured may, e.g, generate the direct component signal $X_{dir}(k, n)$, comprising the direct signal components of the two or more audio input signals $x_1(k, n), x_2(k, n), \ldots x_p(k, n)$, and the diffuse component signal $X_{diff}(k, n)$, comprising diffuse signal components of the two or more audio input signals $x_1(k, n), x_2(k, n), \ldots x_p(k, n)$, by decomposing the one or more audio input signals into the direct component signal and into the diffuse component signal.

In a particular embodiment, the signal processor 105 may, e.g., be configured to generate two or more audio output channels $Y_1(k, n), Y_2(k, n), \ldots, Y_v(k, n)$. The signal processor 105 may, e.g., be configured to apply the diffuse gain Q(k, n) on the diffuse component signal $X_{diff}(k, n)$ to obtain an intermediate diffuse signal. Moreover, the signal processor 105 may, e.g., be configured to generate one or more decorrelated signals from the intermediate diffuse signal by conducting decorrelation, wherein the one or more decorrelated signals form the one or more processed diffuse signals $Y_{diff,1}(k, n), Y_{diff,2}(k, n), \ldots, Y_{diff,v}(k, n)$, or wherein the intermediate diffuse signal and the one or more decorrelated signals form the one or more processed diffuse signals $Y_{diff,1}(k, n), Y_{diff,2}(k, n), \ldots, Y_{diff,v}(k, n)$.

For example, the number of processed diffuse signals $Y_{diff,1}(k, n), Y_{diff,2}(k, n), \ldots, Y_{diff,v}(k, n)$ and the number of audio output signals may, e.g., be equal $Y_1(k, n), Y_2(k, n), \ldots, Y_v(k, n)$.

Generating the one or more decorrelated signals from the intermediate diffuse signal may, e.g, be conducted by applying delays on the intermediate diffuse signal, or, e.g., by convolving the intermediate diffuse signal with a noise burst, or, e.g., by convolving the intermediate diffuse signal with an impulse response, etc. Any other state of the art decorrelation technique may, e.g., alternatively or additionally be applied.

For obtaining v audio output signals $Y_1(k, n), Y_2(k, n), \ldots, Y_v(k, n)$, v determinations of the v direct gains $G_1(k, n), G_2(k, n), \ldots, G_v(k, n)$ and v applications of the respective gain on the one or more direct component signals $X_{dir}(k, n)$ may, for example, be employed to obtain the v audio output signals $Y_1(k, n), Y_2(k, n), \ldots, Y_v(k, n)$.

Only a single diffuse component signal $X_{diff}(k, n)$, only one determination of a single diffuse gain Q(k, n) and only one application of the diffuse gain Q(k, n) on the diffuse component signal $X_{diff}(k, n)$ may, e.g, be needed to obtain the v audio output signals $Y_1(k, n), Y_2(k, n), \ldots, Y_v(k, n)$. To achieve decorrelation, decorrelation techniques may be applied only after the diffuse gain has already been applied on the diffuse component signal.

According to the embodiment of FIG. 1*a*, the same processed diffuse signal $Y_{diff}(k, n)$ is then combined with the corresponding one ($Y_{dir,1}(k, n)$ of the processed direct signals to obtain the corresponding one ($Y_i(k, n)$) of the audio output signals.

The embodiment of FIG. 1*a* takes the direction of arrival of the direct signal components of the two or more audio input signals $x_1(k, n), x_2(k, n), \ldots x_p(k, n)$ into account. Thus, the audio output signals $Y_1(k, n), Y_2(k, n), \ldots, Y_v(k, n)$ can be generated by flexibly adjusting the direct component signals $X_{dir}(k, n)$ and diffuse component signals $X_{diff}(k, n)$ depending on the direction of arrival. Advanced adaptation possibilities are achieved.

According to embodiments, the audio output signals $Y_1(k, n), Y_2(k, n), \ldots, Y_v(k, n)$ may, e.g., be determined for each time-frequency bin (k, n) of a time-frequency domain.

According to an embodiment, the decomposition module 101 may, e.g., be configured to receive two or more audio input signals $x_1(k, n), x_2(k, n), \ldots x_p(k, n)$. In another embodiment, the, decomposition module 101 may, e.g., be configured to receive three or more audio input signals $x_1(k, n), x_2(k, n), \ldots x_p(k, n)$. The decomposition module 101 may, e.g., be configured to decompose the two or more (or three or more audio input signals) $x_1(k, n), x_2(k, n), \ldots x_p(k, n)$ into the diffuse component signal $X_{diff}(k, n)$, which is not a multi-channel signal, and into the one or more direct component signals $X_{dir}(k, n)$.

That an audio signal is not a multi-channel signal means that the audio signal does itself not comprise more than one audio channel. Thus, the audio information of the plurality of audio input signals is transmitted within the two component signals ($X_{dir}(k, n), X_{diff}(k, n)$) (and possibly in additional side information), which allows efficient transmission.

The signal processor 105, may, e.g., be configured to generate each audio output signal $Y_i(k, n)$ of two or more audio output signals $Y_1(k, n), Y_2(k, n), \ldots, Y_v(k, n)$ by determining the direct gain $G_i(k, n)$ for said audio output signal $Y_i(k, n)$, by applying said direct gain $G_i(k, n)$ on the one or more direct component signals $X_{dir}(k, n)$ to obtain the processed direct signal $Y_{dir,i}(k, n)$ for said audio output signal $Y_i(k, n)$, and by combining said processed direct signal $Y_{dir,i}(k, n)$ for said audio output signal $Y_i(k, n)$ and the processed diffuse signal $Y_{diff}(k, n)$ to generate said audio output signal $Y_i(k, n)$. The output interface 106 is configured to output the two or more audio output signals $Y_1(k, n), Y_2(k, n), \ldots, Y_v(k, n)$. Generating two or more audio output signals $Y_1(k, n), Y_2(k, n), \ldots, Y_v(k, n)$ by determining only a single processed diffuse signal $Y_{diff}(k, n)$ is particularly advantageous.

Figure 1B:
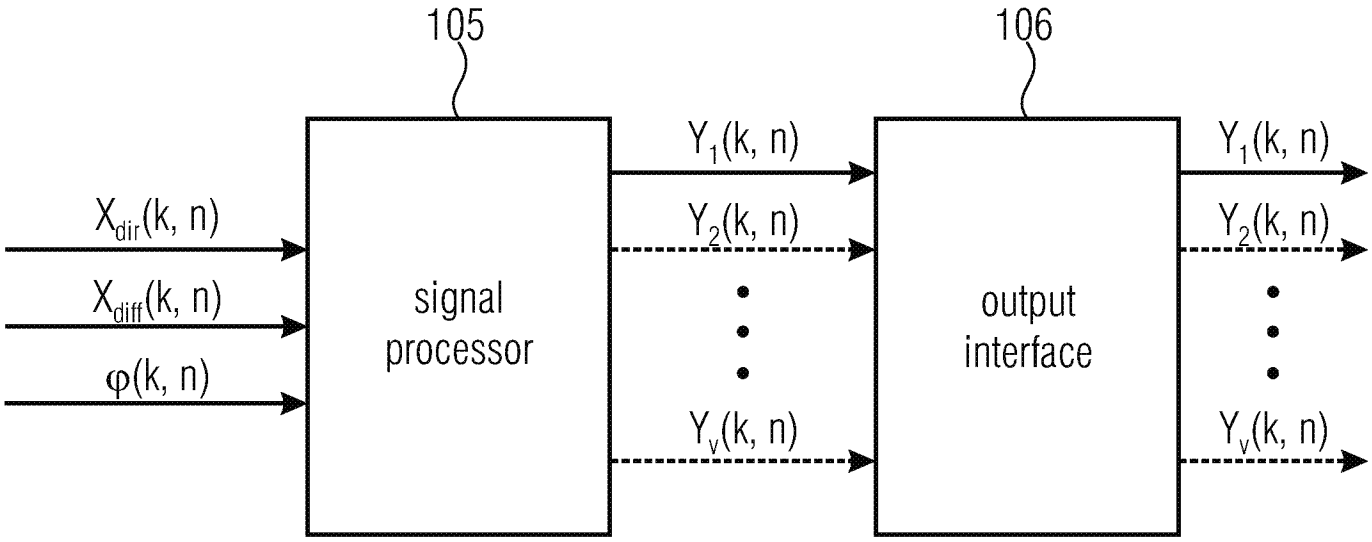
FIG. 1*b* illustrates an apparatus according to an embodiment.

FIG. 1*b* illustrates an apparatus for generating one or more audio output signals $Y_1(k, n), Y_2(k, n), \ldots, Y_v(k, n)$ according to an embodiment. The apparatus implements the so-called "far-end" side of the system of FIG. 1*a*.

The apparatus of FIG. 1*b* comprises a signal processor 105, and an output interface 106.

The signal processor 105 is configured to receive a direct component signal $X_{dir}(k, n)$, comprising direct signal components of the two or more original audio signals $x_1(k, n), x_2(k, n), \ldots x_p(k, n)$ (e.g., the audio input signals of FIG. 1*a*). Moreover, the signal processor 105 is configured to receive a diffuse component signal $X_{diff}(k, n)$, comprising diffuse signal components of the two or more original audio signals $x_1(k, n), x_2(k, n), \ldots x_p(k, n)$. Furthermore, the signal processor 105 is configured to receive direction information, said direction information depending on a direction of arrival of the direct signal components of the two or more audio input signals.

The signal processor 105 is configured to generate one or more processed diffuse signals $Y_{diff,1}(k, n), Y_{diff,2}(k, n), \ldots, Y_{diff,v}(k, n)$ depending on the defuse component signal $X_{diff}(k, n)$.

For each audio output signal $Y_i(k, n)$ of the one or more audio output signals $Y_1(k, n), Y_2(k, n), \ldots, Y_v(k, n)$, the signal processor 105 is configured to determine, depending on the direction of arrival, a direct gain $G_i(k, n)$, the signal processor 105 is configured to apply said direct gain $G_i(k, n)$ on the direct component signal $X_{dir}(k, n)$ to obtain a processed direct signal $Y_{dir,i}(k, n)$, and the signal processor 105 is configured to combine said processed direct signal $Y_{dir,i}(k, n)$ and one $Y_{diff,i}(k, n)$ of the one or more processed diffuse signals $Y_{diff,1}(k, n)$, $Y_{diff,2}(k, n)$, . . . , $Y_{diff,v}(k, n)$ to generate said audio output signal $Y_i(k, n)$.

The output interface 106 is configured to output the one or more audio output signals $Y_1(k, n)$, $Y_2(k, n)$, . . . , $Y_v(k, n)$.

All configurations of the signal processor 105 described with reference to the system in the following, may also be implemented in an apparatus according to FIG. 1*b*. This relates in particular to the various configurations of signal modifier 103 and gain function computation module 104 which are described below. The same applies for the various application examples of the concepts described below.

Figure 1C:
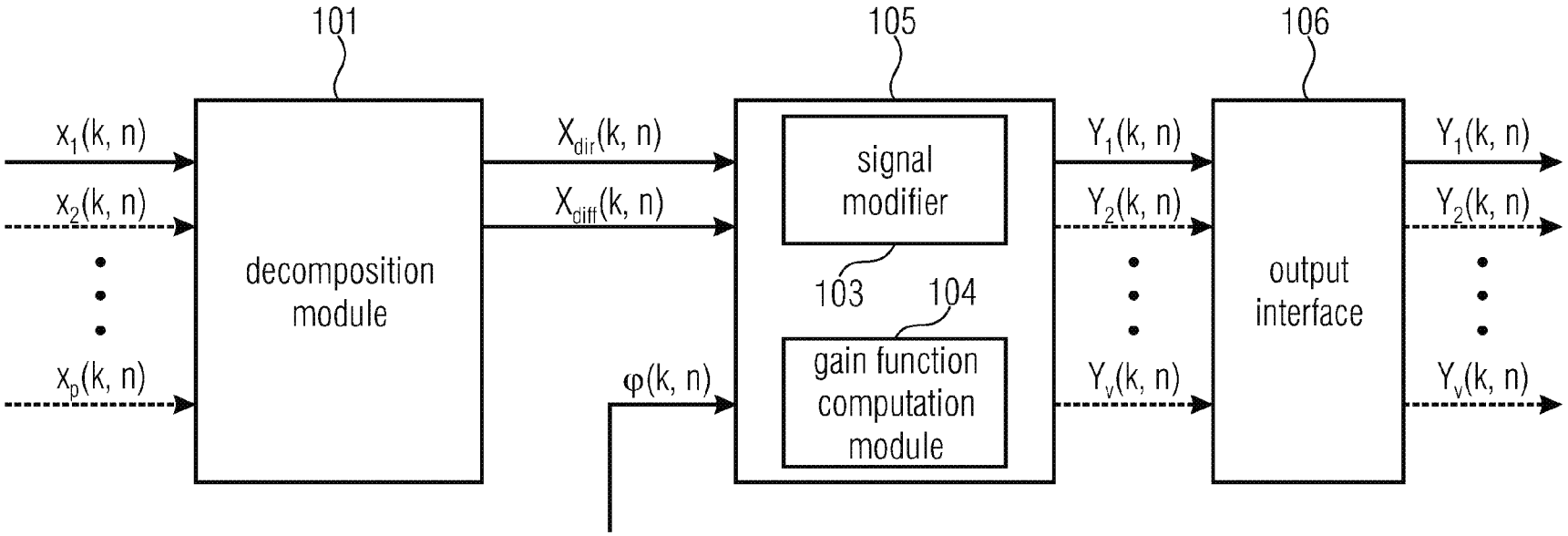
FIG. 1*c* illustrates a system according to another embodiment.

FIG. 1*c* illustrates a system according to another embodiment. In FIG. 1*c*, the signal generator 105 of FIG. 1*a* further comprises a gain function computation module 104 for calculating one or more gain functions, wherein each gain function of the one or more gain functions, comprises a plurality of gain function argument values, wherein a gain function return value is assigned to each of said gain function argument values, wherein, when said gain function receives one of said gain function argument values, wherein said gain function is configured to return the gain function return value being assigned to said one of said gain function argument values.

Furthermore, the signal processor 105 further comprises a signal modifier 103 for selecting, depending on the direction of arrival, a direction dependent argument value from the gain function argument values of a gain function of the one or more gain functions, for obtaining the gain function return value being assigned to said direction dependent argument value from said gain function, and for determining the gain value of at least one of the one or more audio output signals depending on said gain function return value obtained from said gain function.

Figure 1D:
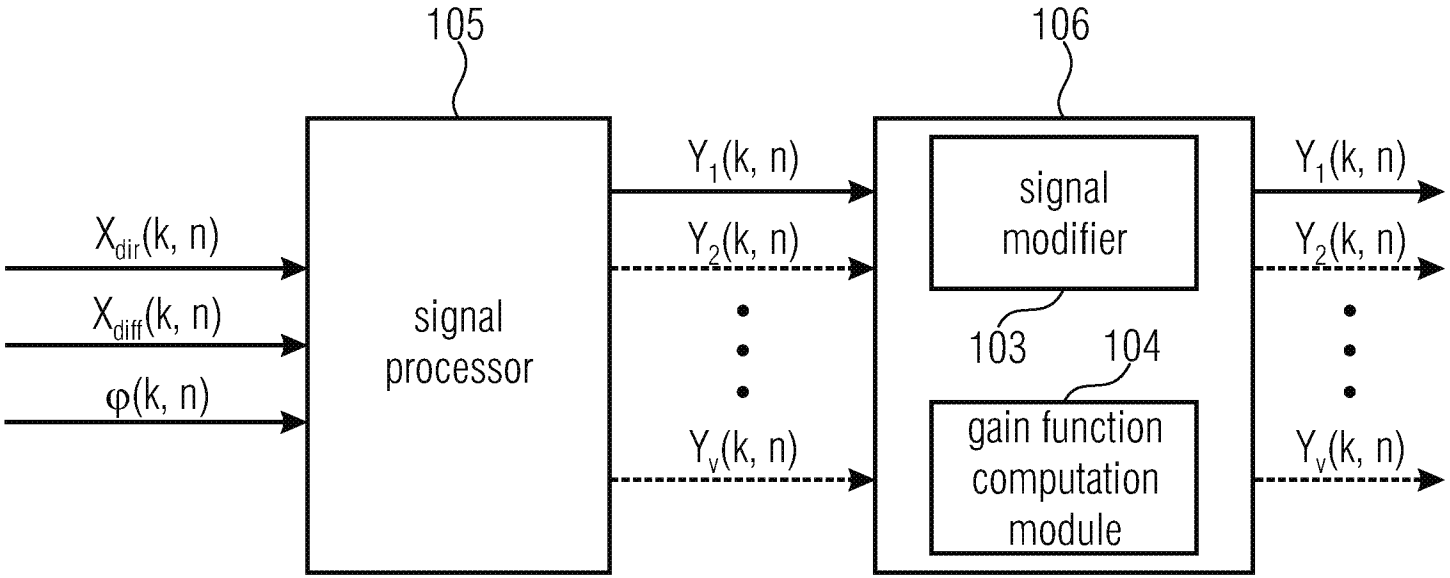
FIG. 1*d* illustrates an apparatus according to another embodiment.

FIG. 1*d* illustrates a system according to another embodiment. In FIG. 1*d*, the signal generator 105 of FIG. 1*b* further comprises a gain function computation module 104 for calculating one or more gain functions, wherein each gain function of the one or more gain functions, comprises a plurality of gain function argument values, wherein a gain function return value is assigned to each of said gain function argument values, wherein, when said gain function receives one of said gain function argument values, wherein said gain function is configured to return the gain function return value being assigned to said one of said gain function argument values.

Furthermore, the signal processor 105 further comprises a signal modifier 103 for selecting, depending on the direction of arrival, a direction dependent argument value from the gain function argument values of a gain function of the one or more gain functions, for obtaining the gain function return value being assigned to said direction dependent argument value from said gain function, and for determining the gain value of at least one of the one or more audio output signals depending on said gain function return value obtained from said gain function.

Embodiments provide recording and reproducing the spatial sound such that the acoustical image is consistent with a desired spatial image, which is determined for instance by a video which is complimenting the audio at the far-end side. Some embodiments are based on recordings with a microphone array located in the reverberant near-end side. Embodiments provide, for example, an acoustical zoom which is consistent to the visual zoom of a camera. For example, when zooming in, the direct sound of the speakers is reproduced from the direction where the speakers would be located in the zoomed visual image, such that the visual and acoustical image are aligned. If the speakers are located outside the visual image (or outside a desired spatial region) after zooming in, the direct sound of these speakers can be attenuated, as these speakers are not visible anymore, or, for example, as the direct sound from these speakers is not desired. Moreover, the direct-to-reverberation ratio may, e.g., be increased when zooming in to mimic the smaller opening angle of the visual camera.

Embodiments are based on the concept to separate the recorded microphone signals into the direct sound of the sound sources and the diffuse sound, e.g., reverberant sound, by applying two recently multi-channel filters at the near-end side. These multi-channel filters may, e.g., be based on parametric information of the sound field, such as the DOA of the direct sound. In some embodiments, the separated direct sound and diffuse sound may, e.g., be transmitted to the far-end side together with the parametric information.

For example, at the far-end side, specific weights may, e.g., be applied to the extracted direct sound and diffuse sound, which adjust the reproduced acoustical image such that the resulting audio output signals are consistent with a desired spatial image. These weights model, for example, the acoustical zoom effect and depend, for example, on the direction of arrival (DOA) of the direct sound and, for example, on a zooming factor and/or a look direction of a camera. The final audio output signals may, e.g., then be obtained by summing up the weighted direct sound and diffuse sound.

The provided concepts realize an efficient usage in the aforementioned video recording scenario with consumer devices or in a teleconferencing scenario: For example, in the video recording scenario, it may, e.g., be sufficient to store or transmit the extracted direct sound and diffuse sound (instead of all microphone signals) while still being able to control the recreated spatial image.

This means, if for instance a visual zoom is applied in a post-processing step (digital zoom), the acoustical image may still be modified accordingly without the need to store and access the original microphone signals. In the teleconferencing scenario, the proposed concepts can also be used efficiently, since the direct and diffuse sound extraction can be carried out at the near-end side while still being able to control the spatial sound reproduction (e.g., changing the loudspeaker setup) at the far-end side and to align the acoustical and visual image. Therefore, it is only necessitated to transmit only few audio signals and the estimated DOAs as side information, while the computational complexity at the far-end side is low.

Figure 2:
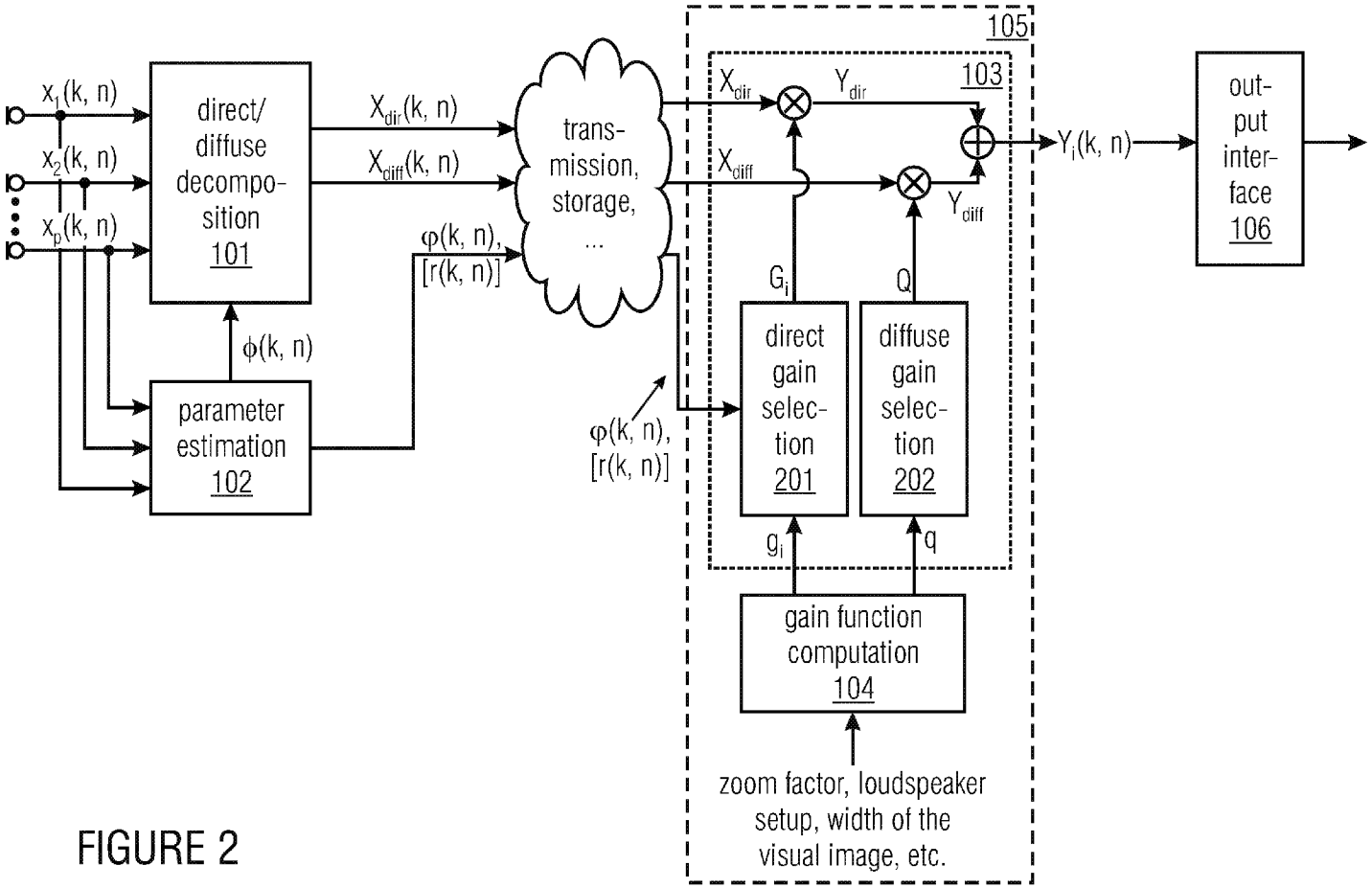
FIG. 2 shows a system according to another embodiment.

FIG. 2 illustrates a system according to an embodiment. The near-end side comprises the modules 101 and 102. The far-end side comprises the module 105 and 106. Module 105 itself comprises the modules 103 and 104. When reference is made to a near-end side and to a far-end side, it is understood that in some embodiments, a first apparatus may implement the near-end side (for example, comprising the modules 101 and 102), and a second apparatus may implement the far end side (for example, comprising the modules 103 and 104), while in other embodiments, a single apparatus implements the near-end side as well as the far-end side, wherein such a single apparatus, e.g., comprises the modules 101, 102, 103 and 104.

In particular, FIG. 2 illustrates a system according to an embodiment comprising a decomposition module 101, a parameter estimation module 102, a signal processor 105, and an output interface 106. In FIG. 2, the signal processor 105 comprises a gain function computation module 104 and a signal modifier 103. The signal processor 105 and the output interface 106 may, e.g., realize an apparatus as illustrated by FIG. 1*b*.

In FIG. 2, inter alia, the parameter estimation module 102 may, e.g., be configured to receive the two or more audio input signals $x_1(k, n)$, $x_2(k, n)$, . . . $x_p(k, n)$. Furthermore the parameter estimation module 102 may, e.g., be configured to estimate the direction of arrival of the direct signal components of the two or more audio input signals $x_1(k, n)$, $x_2(k, n)$, . . . $x_p(k, n)$ depending on the two or more audio input signals. The signal processor 105 may, e.g., be configured to receive the direction of arrival information comprising the direction of arrival of the direct signal components of the two or more audio input signals from the parameter estimation module 102.

The input of the system of FIG. 2 consists of M microphone signals $X_{1 \ldots M}(k, n)$ in the time-frequency domain (frequency index k, time index n). It may, e.g., be assumed that the sound field, which is captured by the microphones, consists for each (k, n) of a plane wave propagating in an isotropic diffuse field. The plane wave models the direct sound of the sound sources (e.g., speakers) while the diffuse sound models the reverberation.

According to such a model, the m-th microphone signal can be written as $$X_m(k,n)=X_{dir,m}(k,n)+X_{diff,m}(k,n)+X_{n,m}(k,n), \tag{1}$$

where $X_{dir,m}(k, n)$ is the measured direct sound (plane wave), $X_{diff,m}(k, n)$ is the measured diffuse sound, and $X_{n,m}(k, n)$ is a noise component (e.g., a microphone self-noise).

In decomposition module 101 in FIG. 2 (direct/diffuse decomposition), the direct sound $X_{dir}(k, n)$ and diffuse sound $X_{diff}(k, n)$ is extracted from the microphone signals. For this purpose, for example, informed multi-channel filters as described below may be employed. For the direct/diffuse decomposition, specific parametric information on the sound field may, e.g., be employed, for example, the DOA of the direct sound $\varphi(k, n)$. This parametric information may, e.g., be estimated from the microphone signals in the parameter estimation module 102. Besides the DOA $\varphi(k, n)$ of the direct sound, in some embodiments, a distance information $r(k, n)$ may, e.g., be estimated. This distance information may, for example, describe the distance between the microphone array and the sound source, which is emitting the plane wave. For the parameter estimation, distance estimators and/or state-of-the-art DOA estimators, may for example, be employed. Corresponding estimators may, e.g., be described below.

The extracted direct sound $X_{dir}(k, n)$, extracted diffuse sound $X_{diff}(k, n)$, and estimated parametric information of the direct sound, for example, DOA $\varphi(k, n)$ and/or distance $r(k, n)$, may, e.g., then be stored, transmitted to the far-end side, or immediately be used to generate the spatial sound with the desired spatial image, for example, to create the acoustic zoom effect.

The desired acoustical image, for example, an acoustical zoom effect, is generated in the signal modifier 103 using the extracted direct sound $X_{dir}(k, n)$, the extracted diffuse sound $X_{diff}(k, n)$, and the estimated parametric information $\varphi(k, n)$ and/or $r(k, n)$.

The signal modifier 103 may, for example, compute one or more output signals $Y_i(k, n)$ in the time-frequency domain which recreate the acoustical image such that it is consistent with the desired spatial image. For example, the output signals $Y_i(k, n)$ mimic the acoustical zoom effect. These signals can be finally transformed back into the time-domain and played back, e.g., over loudspeakers or headphones. The i-th output signal $Y_i(k, n)$ is computed as a weighted sum of the extracted direct sound $X_{dir}(k, n)$ and diffuse sound $X_{diff}(k, n)$, e.g., $$Y_i(k, n) = G_i(k, n)X_{dir}(k, n) + f_i\{\underbrace{QX_{diff}(k, n)}_{Y_{diff}(k,n)}\} \tag{2a}$$

$$= Y_{dir,i}(k, n) + Y_{diff,i}(k, n). \tag{2b}$$

In formulae (2a) and (2b), the weights $G_1(k, n)$ and Q are parameters that are used to create the desired acoustical image, e.g., the acoustical zoom effect. For example, when zooming in, the parameter Q can be reduced such that the reproduced diffuse sound is attenuated.

Moreover, with the weights $G_i(k, n)$ it can be controlled from which direction the direct sound is reproduced such that the visual and acoustical image is aligned. Moreover, an acoustical blurring effect can be aligned to the direct sound.

In some embodiments, the weights $G_i(k, n)$ and Q may, e.g., be determined in gain selection units 201 and 202. These units may, e.g., select the appropriate weights $G_i(k, n)$ and Q from two gain functions, denoted by $g_i$ and q, depending on the estimated parametric information $\varphi(k, n)$ and $r(k, n)$. Expressed mathematically, $$G_i(k,n)=g_i(\varphi,r), \tag{3a}$$

$$Q(k,n)=q(r) \tag{3b}$$

In some embodiments, the gain functions $g_i$ and q may depend on the application and may, for example, be generated in gain function computation module 104. The gain functions describe which weights $G_i(k, n)$ and Q should be used in (2a) for a given parametric information $\varphi(k, n)$ and/or $r(k, n)$ such that the desired consistent spatial image are obtained.

For example, when zooming in with the visual camera, the gain functions are adjusted such that the sound is reproduced from the directions where the sources are visible in the video. The weights $G_i(k, n)$ and Q and underlying gain functions $g_i$ and q are further described below. It should be noted that the weights $G_i(k, n)$ and Q and underlying gain functions $g_i$ and q may, e.g., be complex-valued. Computing the gain functions necessitates information such as the zooming factor, width of the visual image, desired look direction, and loudspeaker setup.

In other embodiments, the weights are $G_i(k, n)$ and Q are directly computed within the signal modifier 103, instead of at first computing the gain functions in module 104 and then selecting the weights $G_i(k, n)$ and Q from the computed gain functions in the gain selection units 201 and 202.

According to embodiments, more than one plane wave per time-frequency may, e.g., be specifically processed. For example, two or more plane waves in the same frequency band from two different directions may, e.g., arrive be recorded by a microphone array at the same point-in-time. These two plane waves may each have a different direction of arrival. In such scenarios, the direct signal components of the two or more plane waves and their direction of arrivals may, e.g., be separately considered.

According to embodiments, the direct component signal $X_{dir1}(k, n)$ and one or more further direct component signals $X_{dir2}(k, n)$, . . . , $X_{dir\ q}(k, n)$ may, e.g, form a group of two or more direct component signals $X_{dir1}(k, n)$, $X_{dir2}(k, n)$, . . . , $X_{dir\ q}(k, n)$, wherein the decomposition module 101 may, e.g., be configured is configured to generate the one or more further direct component signals $X_{dir2}(k, n), \ldots, X_{dir\ q}(k, n)$ comprising further direct signal components of the two or more audio input signals $x_1(k, n)$, $x_2(k, n), \ldots x_p(k, n)$.

The direction of arrival and one or more further direction of arrivals form a group of two or more direction of arrivals, wherein each direction of arrival of the group of the two or more direction of arrivals is assigned to exactly one direct component signal $X_{dir\ j}(k, n)$ of the group of the two or more direct component signals $X_{dir1}(k, n), X_{dir2}(k, n), \ldots, X_{dir\ q,m}(k, n)$, wherein the number of the direct component signals of the two or more direct component signals and the number of the direction of arrivals of the two direction of arrivals is equal.

The signal processor 105 may, e.g., be configured to receive the group of the two or more direct component signals $X_{dir1}(k, n), X_{dir2}(k, n), \ldots, X_{dir\ q}(k, n)$, and the group of the two or more direction of arrivals.

For each audio output signal $Y_i(k, n)$ of the one or more audio output signals $Y_1(k, n), Y_2(k, n), \ldots, Y_v(k, n)$, The signal processor 105 may, e.g, be configured to determine, for each direct component signal $X_{dir\ j}(k, n)$ of the group of the two or more direct component signals $X_{dir1}(k, n), X_{dir2}(k, n), \ldots, X_{dir\ q}(k, n)$, a direct gain $G_{j,i}(k, n)$ depending on the direction of arrival of said direct component signal $X_{dir\ j}(k, n)$, The signal processor 105 may, e.g., be configured to generate a group of two or more processed direct signals $Y_{dir1,i}(k, n), Y_{dir2,i}(k, n), \ldots, Y_{dir\ q,1}(k, n)$ by applying, for each direct component signal $X_{dir\ j}(k, n)$ of the group of the two or more direct component signals $X_{dir1}(k, n), X_{dir2}(k, n), \ldots, X_{dir\ q}(k, n)$, the direct gain $G_{j,i}(k, n)$ of said direct component signal $X_{dir\ j}(k, n)$ on said direct component signal $X_{dir\ j}(k, n)$. And:

The signal processor 105 may, e.g., be configured to combine one $Y_{diff,i}(k, n)$ of the one or more processed diffuse signals $Y_{diff,1}(k, n), Y_{diff,2}(k, n), \ldots, Y_{diff,v}(k, n)$ and each processed signal $Y_{dir\ j,1}(k, n)$ of the group of the two or more processed signals $Y_{dir1,i}(k, n), Y_{dir2,i}(k, n), \ldots, Y_{dir\ q,i}(k, n)$ to generate said audio output signal $Y_i(k, n)$.

Thus, if two or more plane waves are separately considered, the model of formula (1) becomes:

$$X_m(k,n)=X_{dir1,m}(k,n)+X_{dir2,m}(k,n)+\ldots+X_{dir\ q,m}(k,n)+X_{diff,m}(k,n)+X_{n,m}(k,n)$$

and the weights may, e.g., be computed analogously to formulae (2a) and (2b) according to:

$$\begin{aligned} Y_i(k, n) &= G_{1,i}(k, n)X_{dir1}(k, n) + G_{2,i}(k, n)X_{dir2}(k, n) + \ldots + \\ &\quad G_{q,i}(k, n)X_{dirq}(k, n) + QX_{diff,m}(k, n) \\ &= Y_{dir1,i}(k, n) + Y_{dir2,i}(k, n) + \ldots + Y_{dirq,i}(k, n) + Y_{diff,i}(k, n) \end{aligned}$$

It is sufficient that only a few direct component signals, a diffuse component signal and side information is transmitted from a near-end side to a far-end side. In an embodiment, the number of the direct component signal(s) of the group of the two or more direct component signals $X_{dir1}(k, n), X_{dir2}(k, n), \ldots, X_{dir\ q}(k, n)$ plus 1 is smaller than the number of the audio input signals $x_1(k, n), x_2(k, n), \ldots x_p(k, n)$ being received by the receiving interface 101. (using the indices: $q+1<p$) "plus 1" represents the diffuse component signal $X_{diff}(k, n)$ that is needed.

When in the following, explanations are provided with respect to a single plane wave, to a single direction of arrival and to a single direct component signal, it is to be understood that the explained concepts are equally applicable to more than one plane wave, more than one direction of arrival and more than one direct component signal.

In the following, direct and diffuse Sound Extraction is described. Practical realizations of the decomposition module 101 of FIG. 2, which realizes the direct/diffuse decomposition, are provided.

In embodiments, to realize the consistent spatial sound reproduction, the output of two recently proposed informed linearly constrained minimum variance (LCMV) filters described in [8] and [9] are combined, which enable an accurate multi-channel extraction of direct sound and diffuse sound with a desired arbitrary response assuming a similar sound field model as in DirAC (Directional Audio Coding). A specific way of combining these filters according to an embodiment is now described in the following:

At first, direct sound extraction according to an embodiment is described.

The direct sound is extracted using the recently proposed informed spatial filter described in [8]. This filter is briefly reviewed in the following and then formulated such that it can be used in embodiments according to FIG. 2.

The estimated desired direct signal $\hat{Y}_{dir,i}(k,n)$ for the i-th loudspeaker channel in (2b) and FIG. 2 is computed by applying a linear multi-channel filter to the microphone signals, e.g., $$\hat{Y}_{dir,i}(k,n)=w_{dir,i}^{H}(k,n)x(k,n), \tag{4}$$

where the vector $x(k, n)=[X_1(k, n), \ldots, X_M(k, n)]^T$ comprises the M microphone signals and $w_{dir,i}$ is a complex-valued weight vector. Here, the filter weights minimize the noise and diffuse sound comprised by the microphones while capturing the direct sound with the desired gain $G_i(k, n)$. Expressed mathematically, the weights, may, e.g., be computed as $$w_{dir,i}(k, n) = \underset{w}{\operatorname{argmin}} w^H \Phi_u(k, n) w \tag{5}$$

subject to the linear constraint $$w^H a(k,\varphi)=G_i(k,n). \tag{6}$$

Here, $a(k, \varphi)$ is the so-called array propagation vector. The m-th element of this vector is the relative transfer function of the direct sound between the m-th microphone and a reference microphone of the array (without loss of generality the first microphone at position $d_1$ is used in the following description). This vector depends on the DOA $\varphi(k, n)$ of the direct sound.

The array propagation vector is, for example, defined in [8]. In formula (6) of document [8], the array propagation vector is defined according to $$a(k,\varphi_l)=[a_1(k,\varphi_l)\ \ldots\ a_M(k,\varphi_l)]^T$$

wherein $\varphi_l$ is an azimuth angle of a direction of arrival of an l-th plane wave. Thus, the array propagation vector depends on the direction of arrival. If only one plane wave exists or is considered, index l may be omitted.

According to formula (6) of [8], the i-th element $a_i$ of the array propagation vector a describes the phase shift of an l-th plane wave from a first to an i-th microphone is defined according to $$a_i(k,\varphi_l)=\exp\{\jmath\,\kappa r_i \sin\varphi_l(k,n)\}$$

E.g., $r_i$ is equal to a distance between the first and the i-th microphone, κ indicates the wavenumber of the plane wave and J is the imaginary number.

More information on the array propagation vector a and its elements $a_i$ can be found in [8] which is explicitly incorporated herein by reference.

The M×M matrix $\Phi_u(k, n)$ in (5) is the power spectral density (PSD) matrix of the noise and diffuse sound, which can be determined as explained in [8]. The solution to (5) is given by $$w_{dir,i}(k,n)=h_{dir}(k,n)G^*_i(k,n), \tag{7}$$

where $$h_{dir}(k,n)=\varphi_u^{-1}(k,n)a(k,\varphi)[a^H(k,\varphi)\Phi_u^{-1}a(k,\varphi)]^{-1}. \tag{8}$$

Computing the filter necessitates the array propagation vector a(k, φ), which can be determined after the DOA φ(k, n) of the direct sound was estimated [8]. As explained above, the array propagation vector and thus the filter depends on the DOA. The DOA can be estimated as explained below.

The informed spatial filter proposed in [8], e.g., the direct sound extraction using (4) and (7), cannot be directly used in the embodiment in FIG. 2. In fact, the computation necessitates the microphone signals x(k, n) as wells as the direct sound gain $G_i(k, n)$. As can be seen in FIG. 2, the microphone signals x(k, n) are only available at the near-end side while the direct sound gain $G_i(k, n)$ is only available at the far-end side.

In order to use the informed spatial filter in embodiments of the invention, a modification is provided, wherein we substitute (7) into (4), leading to $$\hat{Y}_{dir,i}(k,n)=G_i(k,n)\hat{X}_{dir}(k,n), \tag{9}$$

where $$\hat{X}_{dir}(k,n)=h_{dir}^H(k,n)x(k,n). \tag{10}$$

This modified filter $h_{dir}(k, n)$ is independent from the weights $G_i(k, n)$. Thus, the filter can be applied at the near-end side to obtain the direct sound $\hat{X}_{dir}(k, n)$, which can then be transmitted to the far-end side together with the estimated DOAs (and distance) as side information to provide a full control over the reproduction of the direct sound. The direct sound $\hat{X}_{dir}(k,n)$ may be determined with respect to a reference microphone at a position $d_1$. Therefore, one might also relate to the direct sound components as $\hat{X}_{dir}(k, n, d_1)$, and thus:

$$\hat{X}_{dir}(k,n,d_1)=h_{dir}^H(k,n)x(k,n). \tag{10a}$$

So according to an embodiment, the decomposition module 101 may, e.g., be configured to generate the direct component signal by applying a filter on the two or more audio input signals according to $$\hat{X}_{dir}(k,n)=h_{dir}^H(k,n)x(k,n),$$

wherein k indicates frequency, and wherein n indicates time, wherein $\hat{X}_{dir}$ (k,n) indicates the direct component signal, wherein x(k, n) indicates the two or more audio input signals, wherein $h_{dir}(k, n)$ indicates the filter, with $$h_{dir}(k,n)=\Phi_u^{-1}(k,n)a(k,\varphi)[a^H(k,\varphi)\Phi_u^{-1}a(k,\varphi)]^{-1}.$$

wherein $\Phi_u(k, n)$ indicates a power spectral density matrix of the noise and diffuse sound of the two or more audio input signals, wherein a(k, φ) indicates an array propagation vector, and wherein φ indicates the azimuth angle of the direction of arrival of the direct signal components of the two or more audio input signals.

Figure 3:
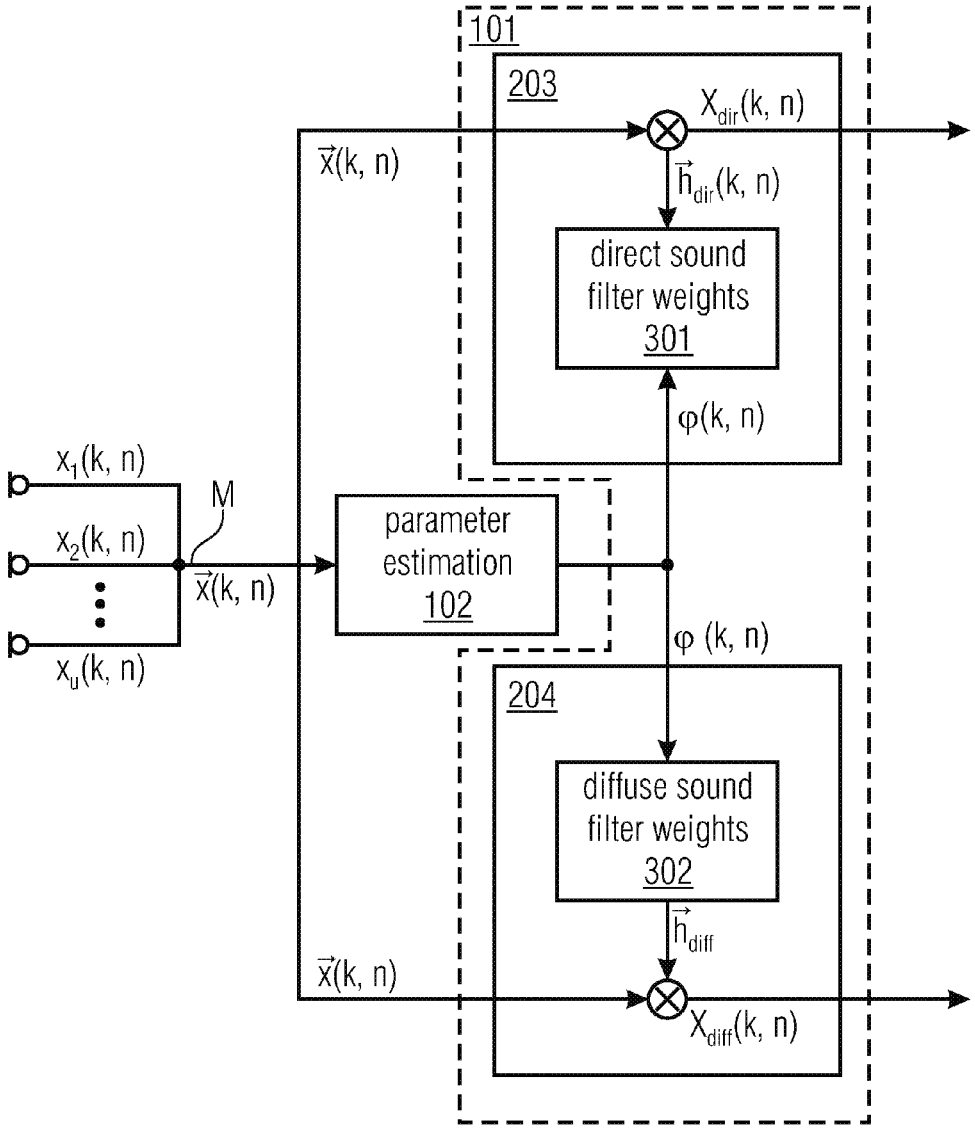
FIG. 3 depicts modules for direct/diffuse decomposition and for parameter of a estimation of a system according to an embodiment.

FIG. 3 illustrates parameter estimation module 102 and a decomposition module 101 implementing direct/diffuse decomposition according to an embodiment.

The embodiment illustrated by FIG. 3 realizes direct sound extraction by direct sound extraction module 203 and diffuse sound extraction by diffuse sound extraction module 204.

The direct sound extraction is carried out in direct sound extraction module 203 by applying the filter weights to the microphone signals as given in (10). The direct filter weights are computed in direct weights computation unit 301 which can be realized for instance with (8). The gains $G_i(k, n)$ of, e.g., equation (9), are then applied at the far-end side as shown in FIG. 2.

In the following, diffuse sound extraction is described. Diffuse sound extraction may, e.g., be implemented by diffuse sound extraction module 204 of FIG. 3. The diffuse filter weights are computed in diffuse weights computation unit 302 of FIG. 3, e.g., as described in the following.

In embodiments, the diffuse sound may, e.g., be extracted using the spatial filter which was recently proposed in [9]. The diffuse sound $X_{diff}(k, n)$ in (2a) and FIG. 2 may, e.g., be estimated by applying a second spatial filter to the microphone signals, e.g., $$\hat{X}_{diff}(k,n)=h_{diff}^H(k,n)x(k,n). \tag{11}$$

To find the optimal filter for the diffuse sound $h_{diff}(k, n)$, we consider the recently proposed filter in [9], which can extract the diffuse sound with a desired arbitrary response while minimizing the noise at the filter output. For spatially white noise, the filter is given by $$h_{diff}(k, n) = \underset{h}{\operatorname{argmin}} h^H h \tag{12}$$

subject to $h^H a(k, \varphi)=0$ and $h^H\gamma_1(k)=1$. The first linear constraint ensures that the direct sound is suppressed, while the second constraint ensures that on average, the diffuse sound is captured with the desired gain Q, see document [9]. Note that $\gamma_1(k)$ is the diffuse sound coherence vector defined in [9]. The solution to (12) is given by $$h_{diff}(k,n)=\Lambda\gamma_{diff}(k)[\gamma_{diff}^H(k)\Lambda\gamma_{diff}(k)]^{-1}, \tag{13}$$

where $$\Lambda(k,\varphi)=I-a(k,\varphi)[a^H(k,\varphi)a(k,\varphi)]^{-1}a^H(k,\varphi) \tag{14}$$

with I being the identity matrix of size M×M. The filter $h_{diff}(k, n)$ does not dependent on the weights $G_i(k, n)$ and Q, and thus, it can be computed and applied at the near-end side to obtain $\hat{X}_{diff}(k, n)$. In doing so, it is only needed to transmit a single audio signal to the far-end side, namely $\hat{X}_{diff}(k, n)$, while still being able to fully control the spatial sound reproduction of the diffuse sound.

FIG. 3 moreover illustrates the diffuse sound extraction according to an embodiment. The diffuse sound extraction is carried out in diffuse sound extraction module 204 by applying the filter weights to the microphone signals as given in formula (11). The filter weights are computed in diffuse weights computation unit 302 which can be realized for example, by employing formula (13).

In the following, parameter estimation is described. Parameter estimation may, e.g., be conducted by parameter estimation module 102, in which the parametric information about the recorded sound scene may, e.g., be estimated. This parametric information is employed for computing two spatial filters in the decomposition module 101 and for the gain selection in consistent spatial audio reproduction in the signal modifier 103.

At first, determination/estimation of DOA information is described.

In the following embodiments are described, wherein the parameter estimation module (102) comprises a DOA estimator for the direct sound, e.g., for the plane wave that originates from the sound source position and arrives at the microphone array. Without the loss of generality, it is assumed that a single plane wave exists for each time and frequency. Other embodiments consider cases where multiple plane waves exists, and extending the single plane wave concepts described here to multiple plane waves is straightforward. Therefore, the present invention also covers embodiments with multiple plane waves.

The narrowband DOAs can be estimated from the microphone signals using one of the state-of-the-art narrowband DOA estimators, such as ESPRIT [10] or root MUSIC [11]. Instead of the azimuth angle $\varphi(k, n)$, the DOA information can also be provided in the form of the spatial frequency $\mu[k|\varphi(k, n)]$, the phase shift, or the propagation vector $a[k|\varphi(k, n)]$ for one or more waves arriving at the microphone array. It should be noted that the DOA information can also be provided externally. For example, the DOA of the plane wave can be determined by a video camera together with a face recognition algorithm assuming that human talkers form the acoustic scene.

Finally, it should be noted that the DOA information can also be estimated in 3D (in three dimensions). In that case, both the azimuth $\varphi(k, n)$ and elevation $\theta(k, n)$ angles are estimated in the parameter estimation module 102 and the DOA of the plane wave is in such a case provided, for example, as $(\varphi, \theta)$.

Thus, when reference is made below to the azimuth angle of the DOA, it is understood that all explanations are also applicable to the elevation angle of the DOA, to an angle or derived from the azimuth angle of the DOA, to an angle or derived from the elevation angle of the DOA or to an angle derived from the azimuth angle and the elevation angle of the DOA. In more general, all explanations provided below are equally applicable to any angle depending on the DOA.

Now, distance information determination/estimation is described.

Some embodiments relate top acoustic zoom based on DOAs and distances. In such embodiments, the parameter estimation module 102 may, for example, comprise two sub-modules, e.g., the DOA estimator sub-module described above and a distance estimation sub-module that estimates the distance from the recording position to the sound source $r(k, n)$. In such embodiments, it may, for example, be assumed that each plane wave that arrives at the recording microphone array originates from the sound source and propagates along a straight line to the array (which is also known as the direct propagation path).

Several state-of-the-art approaches exist for distance estimation using microphone signals. For example, the distance to the source can be found by computing the power ratios between the microphones signals as described in [12]. Alternatively, the distance to the source $r(k, n)$ in acoustic enclosures (e.g., rooms) can be computed based on the estimated signal-to-diffuse ratio (SDR) [13]. The SDR estimates can then be combined with the reverberation time of a room (known or estimated using state-of-the-art methods) to calculate the distance. For high SDR, the direct sound energy is high compared to the diffuse sound which indicates that the distance to the source is small. When the SDR value is low, the direct sound power is week in comparison to the room reverberation, which indicates a large distance to the source.

In other embodiments, instead of calculating/estimating the distance by employing a distance computation module in the parameter estimation module 102, external distance information may, e.g., be received, for example, from the visual system. For example, state-of-the-art techniques used in vision may, e.g., be employed that can provide the distance information, for example, Time of Flight (ToF), stereoscopic vision, and structured light. For example, in the ToF cameras, the distance to the source can be computed from the measured time-of-flight of a light signal emitted by a camera and traveling to the source and back to the camera sensor. Computer stereo vision for example, utilizes two vantage points from which the visual image is captured to compute the distance to the source.

Or, for example, structured light cameras may be employed, where a known pattern of pixels is projected on a visual scene. The analysis of deformations after the projection allows the visual system to estimate the distance to the source. It should be noted that the distance information $r(k, n)$ for each time-frequency bin is necessitated for consistent audio scene reproduction. If the distance information is provided externally by a visual system, the distance to the source $r(k, n)$ that corresponds to the DOA $\varphi(k, n)$, may, for example, be selected as the distance value from the visual system that corresponds to that particular direction $\varphi(k, n)$.

In the following, consistent acoustic scene reproduction is considered. At first, acoustic scene reproduction based on DOAs is considered.

Acoustic scene reproduction may be conducted such that it is consistent with the recorded acoustic scene. Or, acoustic scene reproduction may be conducted such that it is consistent to a visual image. Corresponding visual information may be provided to achieve consistency with a visual image.

Consistency may, for example, be achieved by adjust the weights $G_i(k, n)$ and Q in (2a). According to embodiments, the signal modifier 103, which may, for example, exist, at the near-end side, or, as shown in FIG. 2, at the far-end side, may, e.g., receive the direct $\hat{X}_{dir}(k, n)$ and diffuse $\hat{X}_{diff}(k, n)$ sounds as input, together with the DOA estimates $\varphi(k, n)$ as side information. Based on this received information, the output signals $Y_i(k, n)$ for an available reproduction system may, e.g., be generated, for example, according to formula (2a).

In some embodiments, the parameters $G_i(k, n)$ and Q are selected in the gain selection units 201 and 202, respectively, from two gain functions $g_i(\varphi(k, n))$ and $q(k, n)$ provided by the gain function computation module 104.

According to an embodiment, $G_i(k, n)$ may, for example, be selected based the DOA information only and Q may, for example, have a constant value. In other embodiments, however, other the weight $G_i(k, n)$ may, for example, be determined based on further information, and the weight Q may, for example, be variably determined.

At first, implementations are considered, that realize consistency with the recorded acoustic scene. Afterwards, embodiments are considered that realize consistency with image information/with a visual image is considered.

In the following, a computation of the weights $G_i(k, n)$ and Q is described to reproduce an acoustic scene that is consistent with the recorded acoustic scene, e.g., such that the listener positioned in a sweet spot of the reproduction system perceives the sound sources as arriving from the DOAs of the sound sources in the recorded sound scene, having the same power as in the recorded scene, and reproducing the same perception of the surrounding diffuse sound.

For a known loudspeaker setup, reproduction of the sound source from direction $\varphi(k, n)$ may, for example, be achieved by selecting the direct sound gain $G_i(k, n)$ in gain selection unit 201 ("Direct Gain Selection") from a fixed look-up table provided by gain function computation module 104 for the estimated DOA $\varphi(k, n)$, which can be written as)

$$G_i(k,n)=g_i(\varphi(k,n)), \tag{15}$$

where $g_i(\varphi)=p_i(\varphi)$ is a function returning the panning gain across all DOAs for the i-th loudspeaker. The panning gain function $p_i(\varphi)$ depends on the loudspeaker setup and the panning scheme.

Figure 5A:
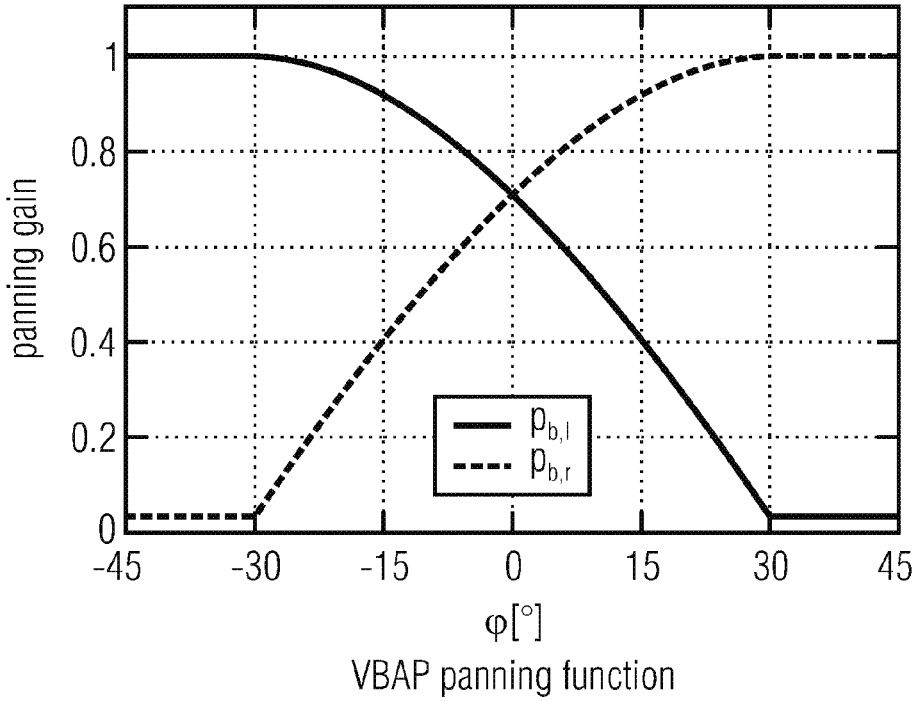
FIG. 5*a-b* illustrates panning functions for consistent scene reproduction and for acoustical zoom.
Figure 5B:
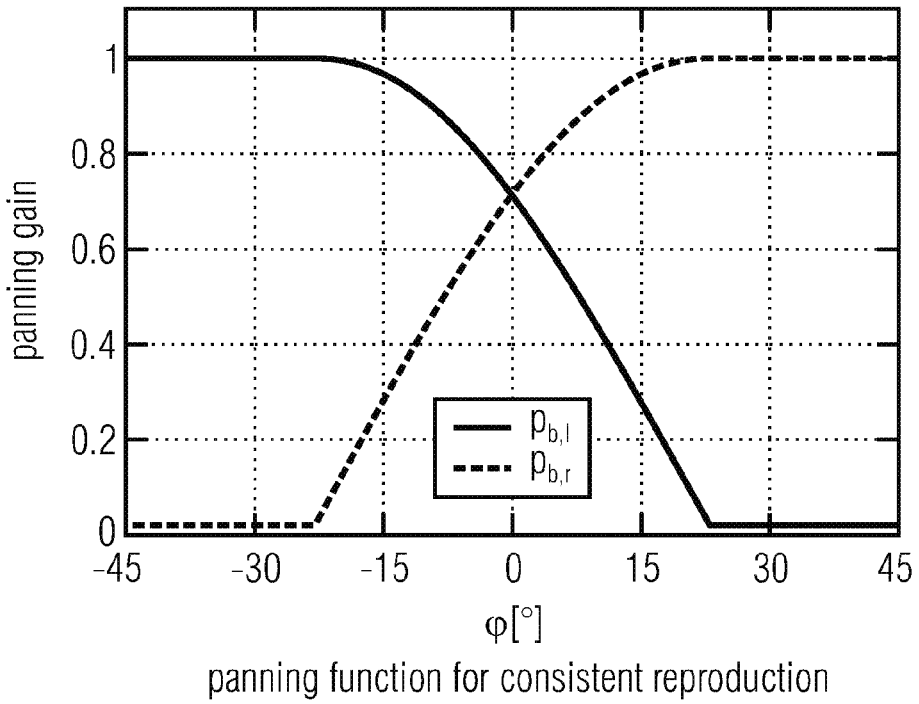

An example of the panning gain function $p_i(\varphi)$ as defined by vector base amplitude panning (VBAP) [14] for the left and right loudspeaker in stereo reproduction is shown in FIG. 5(*a*).

In FIG. 5(*a*), an example of a VBAP panning gain function $p_{b,i}$ for a stereo setup is illustrated, and in FIG. 5(*b*) and panning gains for consistent reproduction is illustrated.

For example, if the direct sound arrives from $\varphi(k, n)=30°$, the right loudspeaker gain is $G_r(k, n)=g_r(30°)=p_r(30°)=1$ and the left loudspeaker gain is $G_l(k, n)=g_l(30°)=p_l(30°)=0$. For the direct sound arriving from $\varphi(k, n)=0°$, the final stereo loudspeaker gains are $G_r(k, n)=G_l(k, n)=\sqrt{0.5}$.

In an embodiment, the panning gain function, e.g., $p_i(\varphi)$, may, e.g., be a head-related transfer function (HRTF) in case of binaural sound reproduction.

For example, if the HRTF $g_i(\varphi)=p_i(\varphi)$ returns complex values then the direct sound gain $G_i(k, n)$ selected in gain selection unit 201 may, e.g., be complex-valued.

If three or more audio output signals shall be generated, corresponding state-of-the-art panning concepts may, e.g., be employed to pan an input signal to the three or more audio output signals. For example, VBAP for three or more audio output signals may be employed.

In consistent acoustic scene reproduction, the power of the diffuse sound should remain the same as in the recorded scene. Therefore, for the loudspeaker system with e.g. equally spaced loudspeakers, the diffuse sound gain has a constant value:

$$Q = q_i = \frac{1}{\sqrt{I}}, \tag{16}$$

where I is the number of the output loudspeaker channels. This means that gain function computation module 104 provides a single output value for the i-th loudspeaker (or headphone channel) depending on the number of loudspeakers available for reproduction, and this values is used as the diffuse gain Q across all frequencies. The final diffuse sound $Y_{diff,i}(k, n)$ for the i-th loudspeaker channel is obtained by decorrelating $Y_{diff}(k, n)$ obtained in (2b).

Thus, acoustic scene reproduction that is consistent with the recorded acoustical scene may be achieved, for example, by determining gains for each of the audio output signals depending on, e.g., a direction of arrival, by applying the plurality of determined gains $G_i(k, n)$ on the direct sound signal $\hat{X}_{dir}(k, n)$ to determine a plurality of direct output signal components $\hat{Y}_{dir,i}(k,n)$, by applying the determined gain Q on the diffuse sound signal $\hat{X}_{diff}(k, n)$ to obtain a diffuse output signal component $\hat{Y}_{diff}(k,n)$ and by combining each of the plurality of direct output signal components $\hat{Y}_{dir,i}(k,n)$ with the diffuse output signal component $\hat{Y}_{diff}(k, n)$ to obtain the one or more audio output signals $Y_i(k,n)$.

Now, audio output signal generation according to embodiments is described that achieves consistency with the visual scene. In particular, the computation of the weights $G_i(k, n)$ and Q according to embodiments is described that are employed to reproduce an acoustic scene that is consistent with the visual scene. It is aimed to recreate an acoustical image in which the direct sound from a source is reproduced from the direction where the source is visible in a video/image.

Figure 4:
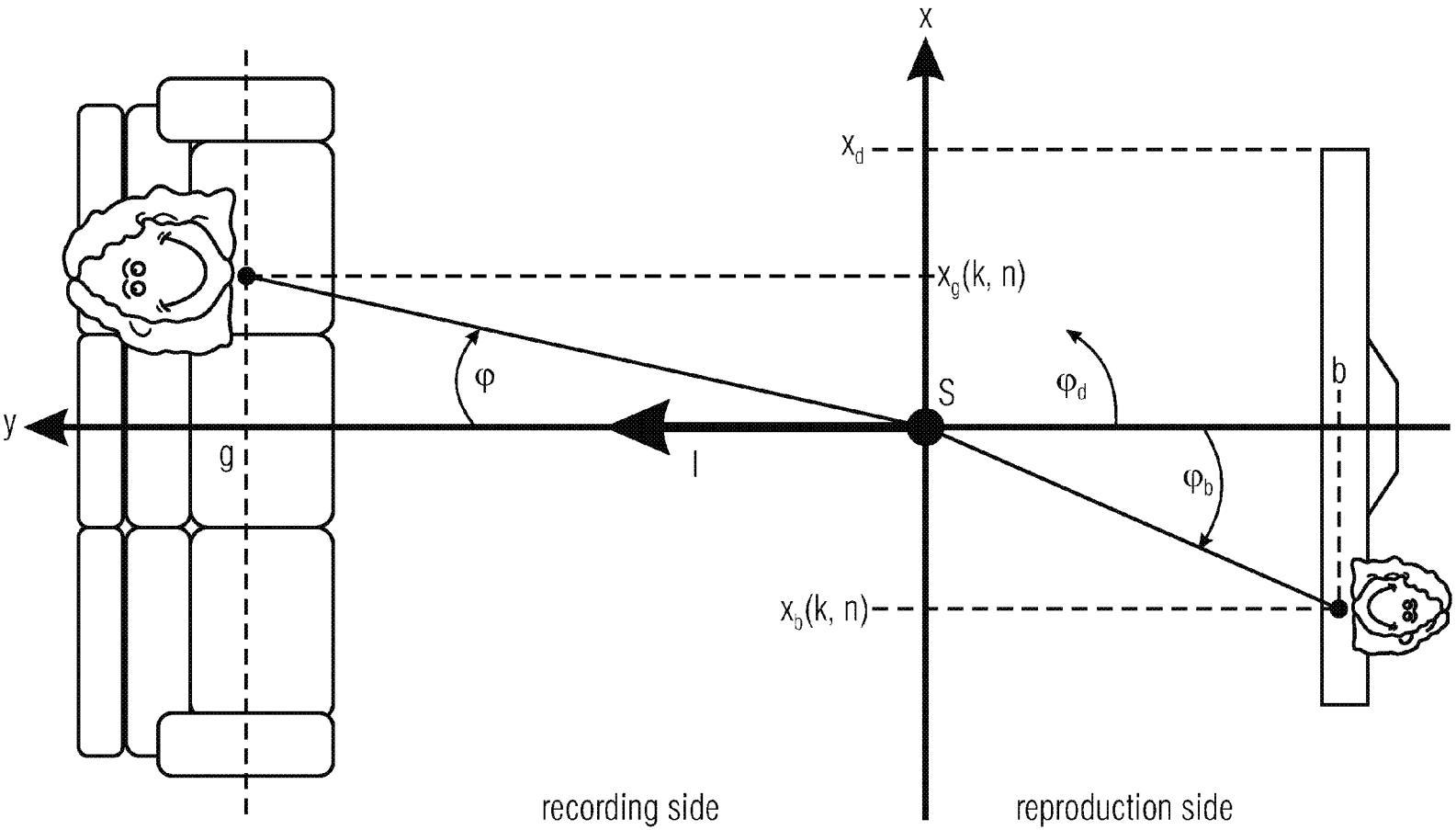
FIG. 4 shows a first geometry for acoustic scene reproduction with acoustic zooming according to an embodiment, wherein a sound source is located on a focal plane.

A geometry as depicted in FIG. 4 may be considered, where I corresponds to the look direction of the visual camera. Without loss of generality, we I may define the y-axis of the coordinate system.

The azimuth of the DOA of the direct sound in the depicted (x, y) coordinate system is given by $\varphi(k, n)$ and the location of the source on the x-axis is given by $x_g(k, n)$. Here, it is assumed that all sound sources are located at the same distance g to the x-axis, e.g., the source positions are located on the left dashed line, which is referred to in optics as a focal plane. It should be noted that this assumption is only made to ensure that the visual and acoustical images are aligned and the actual distance value g is not needed for the presented processing.

On the reproduction side (far-end side), the display is located at b and the position of the source on the display is given by $x_b(k, n)$. Moreover, $x_d$ is the display size (or, in some embodiments, for example, $x_d$ indicates half of the display size), $\varphi_d$ is the corresponding maximum visual angle, S is the sweet spot of the sound reproduction system, and $\varphi_b(k, n)$ is the angle from which the direct sound should be reproduced so that the visual and acoustical images are aligned. $\varphi_b(k, n)$ depends on $x_b(k, n)$ and on the distance between the sweet spot S and the display located at b. Moreover, $x_b(k, n)$ depends on several parameters such as the distance g of the source from the camera, the image sensor size, and the display size $x_d$. Unfortunately, at least some of these parameters are often unknown in practice such that $x_b(k, n)$ and $\varphi_b(k, n)$ cannot be determined for a given DOA $\varphi_g(k, n)$. However, assuming the optical system is linear, according to formula (17):

$$\tan \varphi_b(k,n)=c \tan \varphi(k,n), \tag{17}$$

where c is an unknown constant compensating for the aforementioned unknown parameters. It should be noted that c is constant only if all source positions have the same distance g to the x-axis.

In the following, c is assumed to be a calibration parameter which should be adjusted during the calibration stage until the visual and acoustical images are consistent. To perform calibration, the sound sources should be positioned on a focal plane and the value of c is found such that the visual and acoustical images are aligned. Once calibrated, the value of c remains unchanged and the angle from which the direct sound should be reproduced is given by $$\varphi_b(k,n)=\tan^{-1}[c \tan \varphi(k,n)]. \tag{18}$$

To ensure that both acoustic and visual scenes are consistent, the original panning function $p_i(\varphi)$ is modified to a consistent (modified) panning function $p_{b,i}(\varphi)$. The direct sound gain $G_i(k, n)$ is now selected according to $$G_i(k,n)=g_i(\varphi(k,n)), \tag{19}$$

$$g_i(\varphi)=p_{b,i}(\varphi), \tag{20}$$

where $p_{h,i}(\varphi)$ is the consistent panning function returning the panning gains for the i-th loudspeaker across all possible source DOAs. For a fixed value of c, such a consistent panning function is computed in the gain function computation module 104 from the original (e.g. VBAP) panning gain table as $$p_{b,i}(\varphi)=p_i(\tan^{-1}[c \tan \varphi]). \quad (21)$$

Thus, in embodiments, the signal processor 105 may, e.g., be configured to determine, for each audio output signal of the one or more audio output signals, such that the direct gain $G_i(k, n)$ is defined according to $$G_i(k,n)=p_i(\tan^{-1}[c \tan(\varphi(k,n))]).$$

wherein i indicates an index of said audio output signal, wherein k indicates frequency, and wherein n indicates time, wherein $G_i(k, n)$ indicates the direct gain, wherein $\varphi(k, n)$ indicates an angle depending on the direction of arrival (e.g., the azimuth angle of the direction of arrival), wherein c indicates a constant value, and wherein $p_i$ indicates a panning function.

In embodiments, the direct sound gain $G_i(k, n)$ is selected in gain selection unit 201 based on the estimated DOA $\varphi(k, n)$ from a fixed look-up table provided by the gain function computation module 104, which is computed once (after the calibration stage) using (19).

Thus, according to an embodiment, the signal processor 105 may, e.g., be configured to obtain, for each audio output signal of the one or more audio output signals, the direct gain for said audio output signal from a lookup table depending on the direction of arrival.

In an embodiment, the signal processor 105 calculates a lookup table for the direct gain function $g_i(k, n)$. For example, for every possible full degree, e.g., 1°, 2°, 3°, . . . , for the azimuth value $\varphi$ of the DOA, the direct gain $G_i(k, n)$ may be computed and stored in advance. Then, when a current azimuth value $\varphi$ of the direction of arrival is received, the signal processor 105 reads the direct gain $G_i(k, n)$ for the current azimuth value $\varphi$ from the lookup table. (The current azimuth value $\varphi$, may, e.g., be the lookup table argument value; and the direct gain $G_i(k, n)$ may, e.g., be the lookup table return value). Instead of the azimuth $\varphi$ of the DOA, in other embodiments, the lookup table may be computed for any angle depending on the direction of arrival. This has an advantage, that the gain value does not have to be calculated for every point-in-time, or for every time-frequency bin, but instead, the lookup table is calculated once and then, for a received angle $\varphi$, the direct gain $G_i(k, n)$ is read from the lookup table.

Thus, according to an embodiment, the signal processor 105 may, e.g., be configured to calculate a lookup table, wherein the lookup table comprises a plurality of entries, wherein each of the entries comprises a lookup table argument value and a lookup table return value being assigned to said argument value. The signal processor 105 may, e.g., be configured to obtain one of the lookup table return values from the lookup table by selecting one of the lookup table argument values of the lookup table depending on the direction of arrival. Furthermore, the signal processor 105 may, e.g., be configured to determine the gain value for at least one of the one or more audio output signals depending said one of the lookup table return values obtained from the lookup table.

The signal processor 105 may, e.g., be configured to obtain another one of the lookup table return values from the (same) lookup table by selecting another one of the lookup table argument values depending on another direction of arrival to determine another gain value. E.g., the signal processor may, for example, receive further direction information, e.g., at a later point-in-time, which depends on said further direction of arrival.

An example of VBAP panning and consistent panning gain functions are shown in FIGS. 5(*a*) and 5(*b*).

It should be noted that instead of recomputing the panning gain tables, one could alternatively calculate the DOA $\varphi_b(k, n)$ for the display and apply it in the original panning function as $\varphi_i(\varphi_b(k, n))$. This is true since the following relation holds:

$$p_{b,i}(\varphi(k,n))=p_i(\varphi_b(k,n)). \quad (22)$$

However, this would necessitate the gain function computation module 104 to also receive the estimated DOAs $\varphi(k, n)$ as input and the DOA recalculation, for example, conducted according to formula (18), would then be performed for each time index n.

Concerning the diffuse sound reproduction, the acoustical and visual images are consistently recreated when processed in the same way as explained for the case without the visuals, e.g., when the power of the diffuse sound remains the same as the diffuse power in the recorded scene and the loudspeaker signals are uncorrelated versions of $Y_{diff}(k, n)$. For equally spaced loudspeakers, the diffuse sound gain has a constant value, e.g., given by formula (16). As a result, the gain function computation module 104 provides a single output value for the i-th loudspeaker (or headphone channel) which is used as the diffuse gain Q across all frequencies. The final diffuse sound $Y_{diff,i}(k, n)$ for the i-th loudspeaker channel is obtained by decorrelating $Y_{diff}(k, n)$, e.g., as given by formula (2b).

Now, embodiments are considered, where an acoustic zoom based on DOAs is provided. In such embodiments, the processing for an acoustic zoom may be considered that is consistent with the visual zoom. This consistent audio-visual zoom is achieved by adjusting the weights $G_i(k, n)$ and Q, for example, employed in formula (2a) as depicted in the signal modifier 103 of FIG. 2.

In an embodiment, the direct gain $G_i(k, n)$ may, for example, be selected in gain selection unit 201 from the direct gain function $g_i(k, n)$ computed in the gain function computation module 104 based on the DOAs estimated in parameter estimation module 102. The diffuse gain Q is selected in the gain selection unit 202 from the diffuse gain function $q(\beta)$ computed in the gain function computation module 104. In other embodiments, the direct gain $G_i(k, n)$ and the diffuse gain Q are computed by the signal modifier 103 without computing first the respective gain functions and then selecting the gains.

It should be noted that in contrast to the above-described embodiment, the diffuse gain function $q(\beta)$ is determined based on the zoom factor $\beta$. In embodiments, the distance information is not used, and thus, in such embodiments, it is not estimated in the parameter estimation module 102.

To derive the zoom parameters $G_i(k, n)$ and Q in (2a), the geometry in FIG. 4 is considered. The parameters denoted in the figure are analogous to those described with respect to FIG. 4 in the embodiment above.

Similarly to the above-described embodiment, it is assumed that all sound sources are located on the focal plane, which is positioned parallel to the x-axis at a distance g. It should be noted that some autofocus systems are able to provide g, e.g., the distance to the focal plane. This allows to assume that all sources in the image are sharp. On the reproduction (far-end) side, the DOA $\varphi_b(k, n)$ and position $x_b(k, n)$ on a display depend on many parameters such as the distance g of the source from the camera, the image sensor size, the display size $x_d$, and zooming factor of the camera (e.g., opening angle of the camera) β. Assuming the optical system is linear, according to formula (23):

$$\tan \varphi_b(k,n)=\beta c \tan \varphi(k,n) \tag{23}$$

where c is the calibration parameter compensating for the unknown optical parameters and β≥1 is the user-controlled zooming factor. It should be noted that in a visual camera, zooming in by a factor β is equivalent to multiplying $x_b$(k, n) by β. Moreover, c is constant only if all source positions have the same distance g to the x-axis. In this case, c can be considered as a calibration parameter which is adjusted once such that the visual and acoustical images are aligned. The direct sound gain $G_i$(k, n) is selected from the direct gain function $g_i(\varphi)$ as $$G_i(k,n)=g_i(\varphi(k,n)), \tag{24}$$

$$g_i(\varphi)=p_{b,i}(\varphi)w_b(\varphi), \tag{25}$$

where $p_{b,i}(\varphi)$ denotes the panning gain function and $w_b(\varphi)$ is the window gain function for a consistent audio-visual zoom. The panning gain function for a consistent audio-visual zoom is computed in the gain function computation module 104 from the original (e.g. VBAP) panning gain function $p_i(\varphi)$ as $$p_{b,i}(\varphi)=p_i(\tan^{-1}[\beta c \tan \varphi]). \tag{26}$$

Thus the direct sound gain $G_i$(k, n), e.g., selected in the gain selection unit 201, is determined based on the estimated DOA φ(k, n) from a look-up panning table computed in the gain function computation module 104, which is fixed if β does not change. It should be noted that, in some embodiments, $p_{b,i}(\varphi)$ needs to be recomputed, for example, by employing formula (26) every time the zoom factor β is modified.

Figure 6A:
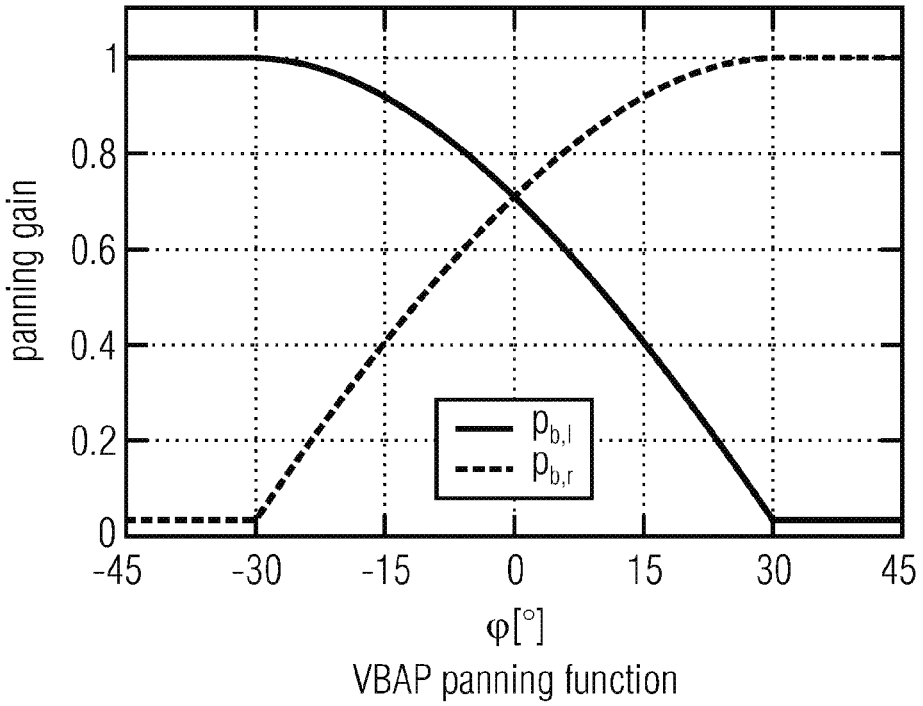
FIG. 6*a-c* depicts further panning functions for consistent scene reproduction and for acoustical zoom according to embodiments.
Figure 6B:
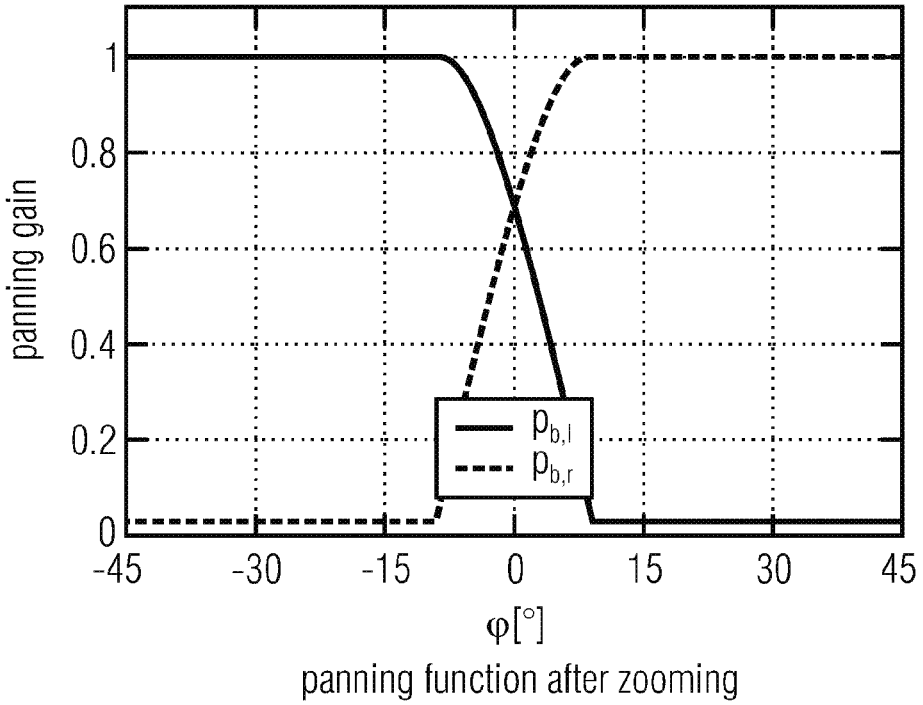
Figure 6C:
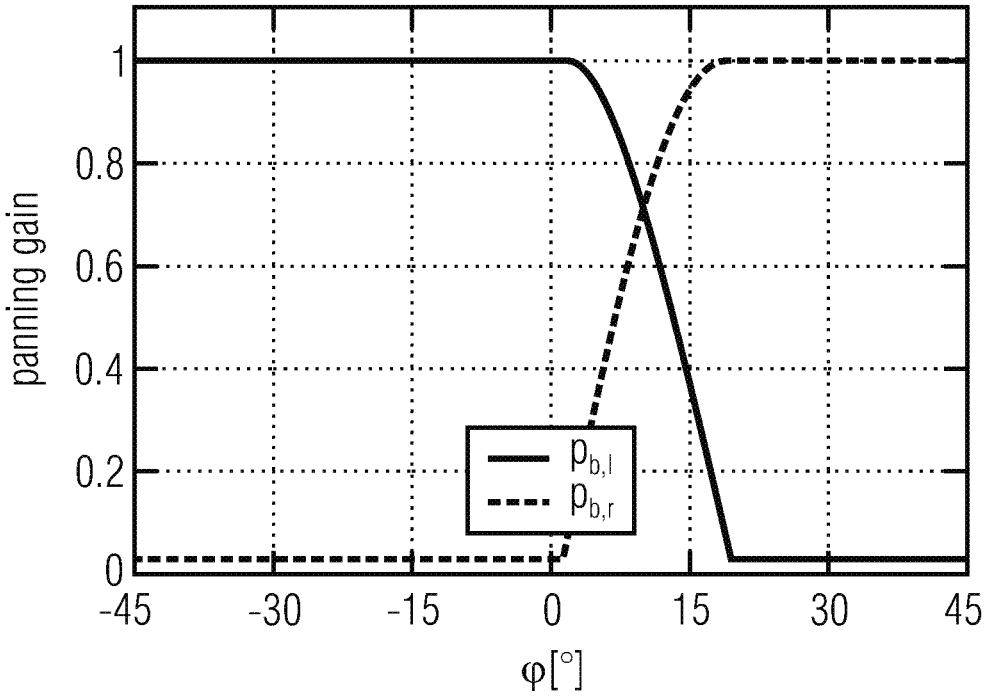

Example stereo panning gain functions for β=1 and β=3 are shown in FIG. 6 (see FIG. 6(*a*) and FIG. 6(*b*)). In particular, FIG. 6(*a*) illustrates an example panning gain function $p_{b,i}$ for β=1; FIG. 6(*b*) illustrates panning gains after zooming with β=3; and FIG. 6(*c*) illustrates panning gains after zooming with β=3 with an angular shift.

As can be seen in the example, when the direct sound arrives from φ(k, n)=10°, the panning gain for the left loudspeaker is increased for large β values, while the panning function for the right loudspeaker and β=3 returns a smaller value than for β=1. Such panning effectively moves the perceived source position more to the outer directions when zoom factor β is increased.

According to embodiments, the signal processor 105 may, e.g., be configured to determine two or more audio output signals. For each audio output signal of the two or more audio output signals, a panning gain function is assigned to said audio output signal.

The panning gain function of each of the two or more audio output signals comprises a plurality of panning function argument values, wherein a panning function return value is assigned to each of said panning function argument values, wherein, when said panning function receives one of said panning function argument values, said panning function is configured to return the panning function return value being assigned to said one of said panning function argument values. and The signal processor 105 is configured to determine each of the two or more audio output signals depending on a direction dependent argument value of the panning function argument values of the panning gain function being assigned to said audio output signal, wherein said direction dependent argument value depends on the direction of arrival.

According to an embodiment, the panning gain function of each of the two or more audio output signals has one or more global maxima, being one of the panning function argument values, wherein for each of the one or more global maxima of each panning gain function, no other panning function argument value exists for which said panning gain function returns a greater panning function return value than for said global maxima.

For each pair of a first audio output signal and a second audio output signal of the two or more audio output signals, at least one of the one or more global maxima of the panning gain function of the first audio output signal is different from any of the one or more global maxima of the panning gain function of the second audio output signal.

Stated in short, the panning functions are implemented such that (at least one of) the global maxima of different panning functions differ.

For example, in FIG. 6(*a*), the local maxima of $p_{b,l}(\varphi)$ are in the range −45° to −28° and the local maxima of $p_{b,r}(\varphi)$ are in the range +28° to +45° and thus, the global maxima differ.

For example, in FIG. 6(*b*), the local maxima of $p_{b,l}(\varphi)$ are in the range −45° to −8° and the local maxima of $p_{b,r}(\varphi)$ are in the range +8° to +45° and thus, the global maxima also differ.

For example, in FIG. 6(*c*), the local maxima of $p_{b,l}(\varphi)$ are in the range −45° to +2° and the local maxima of $p_{b,r}(\varphi)$ are in the range +18° to +45° and thus, the global maxima also differ.

The panning gain function may, e.g, be implemented as a lookup table.

In such an embodiment, the signal processor 105 may, e.g., be configured to calculate a panning lookup table for a panning gain function of at least one of the audio output signals.

The panning lookup table of each audio output signal of said at least one of the audio output signals may, e.g., comprise a plurality of entries, wherein each of the entries comprises a panning function argument value of the panning gain function of said audio output signal and the panning function return value of the panning gain function being assigned to said panning function argument value, wherein the signal processor 105 is configured to obtain one of the panning function return values from said panning lookup table by selecting, depending on the direction of arrival, the direction dependent argument value from the panning lookup table, and wherein the signal processor 105 is configured to determine the gain value for said audio output signal depending on said one of the panning function return values obtained from said panning lookup table.

In the following, embodiments are described that employ a direct sound window. According to such embodiments, a direct sound window for the consistent zoom $w_b(\varphi)$ is computed according to $$w_b(\varphi)=w(\tan^{-1}[\beta c \tan \varphi]), \tag{27}$$

where $w_b(\varphi)$ is a window gain function for an acoustic zoom that attenuates the direct sound if the source is mapped to a position outside the visual image for the zoom factor β.

The window function w(φ) may, for example, be set for β=1, such that the direct sound of sources that are outside the visual image are reduced to a desired level, and it may be recomputed, for example, by employing formula (27), every time the zoom parameter changes. It should be noted that $w_b(\varphi)$ is the same for all loudspeaker channels. Example window functions for $\beta=1$ and $\beta=3$ are shown in FIG. 7(*a-b*), where for an increased fi value the window width is decreased.

Figure 7A:
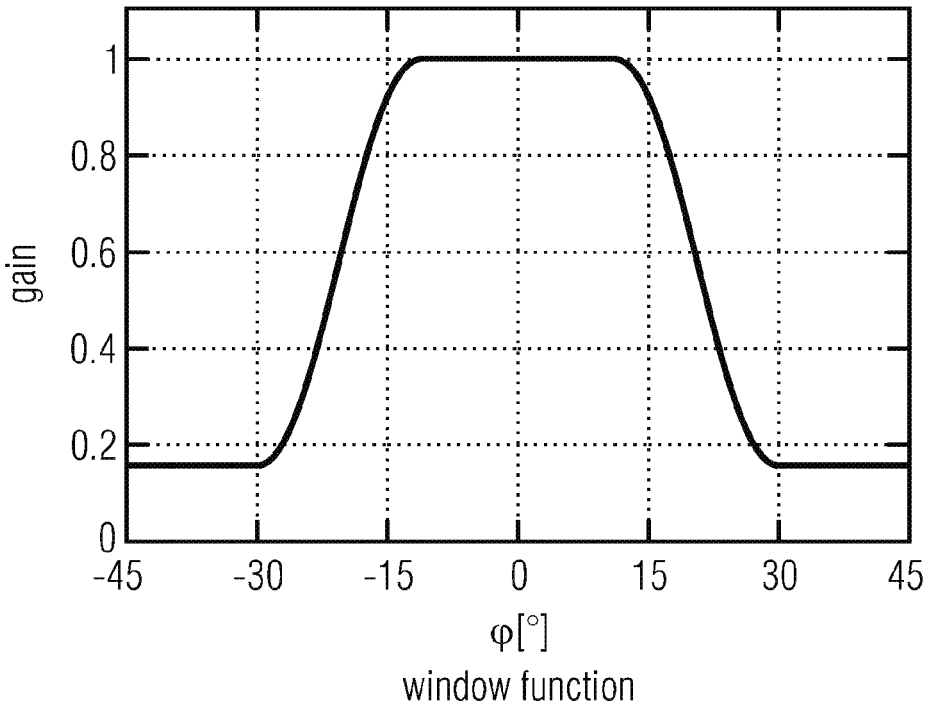
FIG. 7*a-c* illustrates example window gain functions for various situations according to embodiments.
Figure 7B:
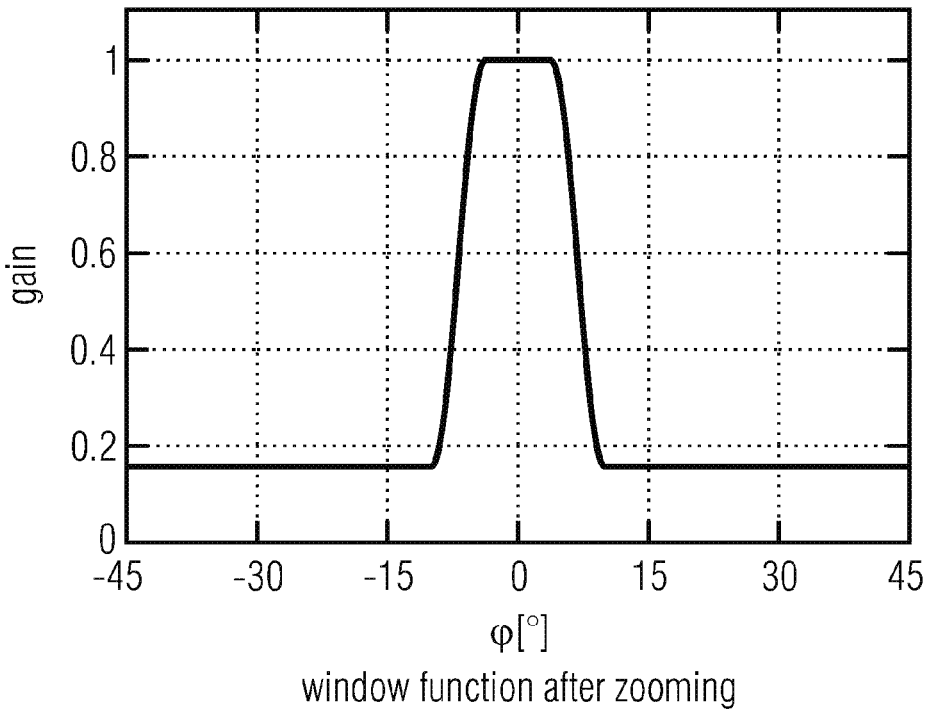
Figure 7C:
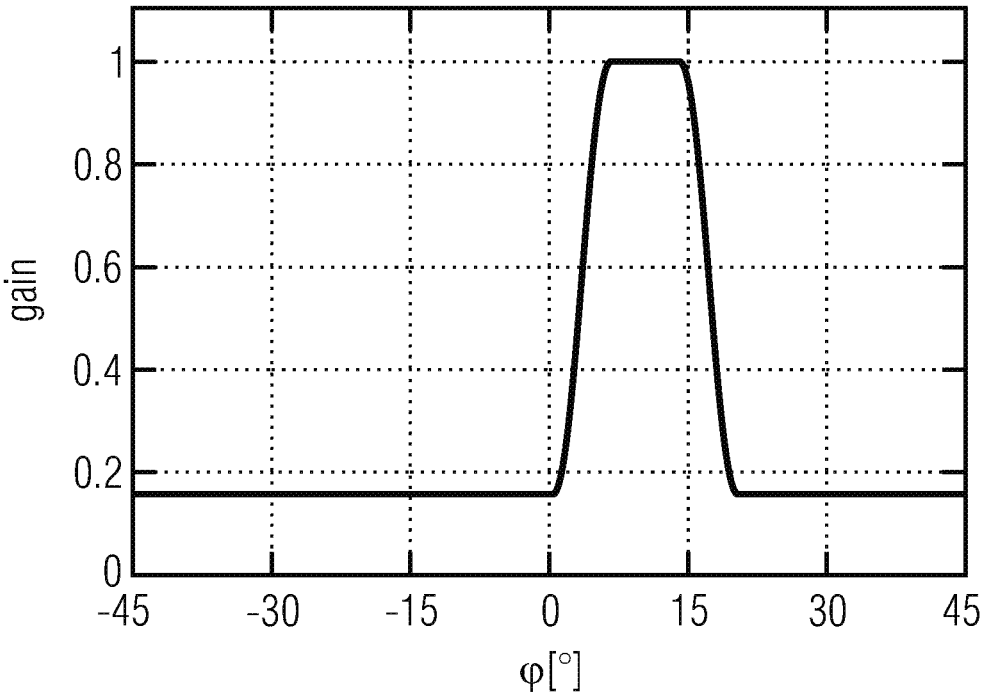

In FIG. 7 examples of consistent window gain functions are illustrated. In particular, FIG. 7(*a*) illustrates a window gain function $w_b$ without zooming (zoom factor $\beta=1$), FIG. 7(*b*) illustrates a window gain function after zooming (zoom factor $\beta=3$), FIG. 7(*c*) illustrates a window gain function after zooming (zoom factor $\beta=3$) with an angular shift. For example, the angular shift may realize a rotation of the window to a look direction.

For example, in FIGS. 7(*a*), 7(*b*) and 7(*c*) the window gain function returns a gain of 1, if the DOA $\varphi$ is located within the window, the window gain function returns a gain of 0.18, if $\varphi$ is located outside the window, and the window gain function returns a gain between 0.18 and 1, if $\varphi$ is located at the border of the window.

According to embodiments, the signal processor 105 is configured to generate each audio output signal of the one or more audio output signals depending on a window gain function. The window gain function is configured to return a window function return value when receiving a window function argument value.

If the window function argument value is greater than a lower window threshold and smaller than an upper window threshold, the window gain function is configured to return a window function return value being greater than any window function return value returned by the window gain function, if the window function argument value is smaller than the lower threshold, or greater than the upper threshold.

For example, in formula (27)

$$w_b(\varphi)=w(\tan^{-1}[\beta c \tan \varphi]),$$

the azimuth angle of the direction of arrival $\varphi$ is the window function argument value of the window gain function $w_b(\varphi)$. The window gain function $w_b(\varphi)$ depends on zoom information, here, zoom factor $\beta$.

To explain the definition of the window gain function, reference may be made to FIG. 7(*a*).

If the azimuth angle of the DOA $\varphi$ is greater than $-20°$ (lower threshold) and smaller than $+20°$ (upper threshold), all values returned by the window gain function are greater than 0.6. Otherwise, if the azimuth angle of the DOA $\varphi$ is smaller than $-20°$ (lower threshold) or greater than $+20°$ (upper threshold), all values returned by the window gain function are smaller than 0.6.

In an embodiment, the signal processor 105 is configured to receive zoom information. Moreover the signal processor 105 is configured to generate each audio output signal of the one or more audio output signals depending on the window gain function, wherein the window gain function depends on the zoom information.

This can be seen for the (modified) window gain functions of FIG. 7(*b*) and FIG. 7(*c*) if other values are considered as lower/upper thresholds or if other values are considered as return values. In FIGS. 7(*a*), 7(*b*) and 7(*c*), it can be seen, that the window gain function depends on the zoom information: zoom factor $\beta$.

The window gain function may, e.g., be implemented as a lookup table. In such an embodiment, the signal processor 105 is configured to calculate a window lookup table, wherein the window lookup table comprises a plurality of entries, wherein each of the entries comprises a window function argument value of the window gain function and a window function return value of the window gain function being assigned to said window function argument value. The signal processor 105 is configured to obtain one of the window function return values from the window lookup table by selecting one of the window function argument values of the window lookup table depending on the direction of arrival. Moreover, the signal processor 105 is configured to determine the gain value for at least one of the one or more audio output signals depending said one of the window function return values obtained from the window lookup table.

In addition to the zooming concept, the window and panning functions can be shifted by a shift angle $\theta$. This angle could correspond to either the rotation of a camera look direction I or to moving within an visual image by analogy to a digital zoom in cameras. In the former case, the camera rotation angle is recomputed for the angle on a display, e.g., similarly to formula (23). In the latter case, $\theta$ can be a direct shift of the window and panning functions (e.g. $w_b(\varphi)$ and $p_{b,i}(\varphi)$ for the consistent acoustical zoom. An illustrative example a shifting both functions is depicted in FIGS. 5(*c*) and 6(*c*).

It should be noted that instead of recomputing the panning gain and window functions, one could calculate the DOA $\varphi_b(k, n)$ for the display, for example, according to formula (23), and apply it in the original panning and window functions as $p_i(\varphi)$ and $w(\varphi_b)$, respectively. Such processing is equivalent since the following relations holds:

$$p_{b,i}(\varphi(k,n))=p_i(\varphi_b(k,n)), \tag{28}$$

$$w_b(\varphi(k,n))=w(\varphi(\varphi_b(k,n)). \tag{29}$$

However, this would necessitate the gain function computation module 104 to receive the estimated DOAs $\varphi(k, n)$ as input and the DOA recalculation, for example according to formula (18), may, e.g., be performed in each consecutive time frame, irrespective if $\beta$ was changed or not.

As for the diffuse sound, computing the diffuse gain function $q(\beta)$, e.g., in the gain function computation module 104, necessitates only the knowledge of the number of loudspeakers I available for reproduction. Thus, it can be set independently from the parameters of a visual camera or the display.

For example, for equally spaced loudspeakers, the real-valued diffuse sound gain $Q\epsilon[0, 1/\sqrt{I}]$ in formula (2a) is selected in the gain selection unit 202 based on the zoom parameter $\beta$. The aim of using the diffuse gain is to attenuate the diffuse sound depending on the zooming factor, e.g., zooming increases the DRR of the reproduced signal. This is achieved by lowering Q for larger $\beta$. In fact, zooming in means that the opening angle of the camera becomes smaller, e.g., a natural acoustical correspondence would be a more directive microphone which captures less diffuse sound.

Figure 8:
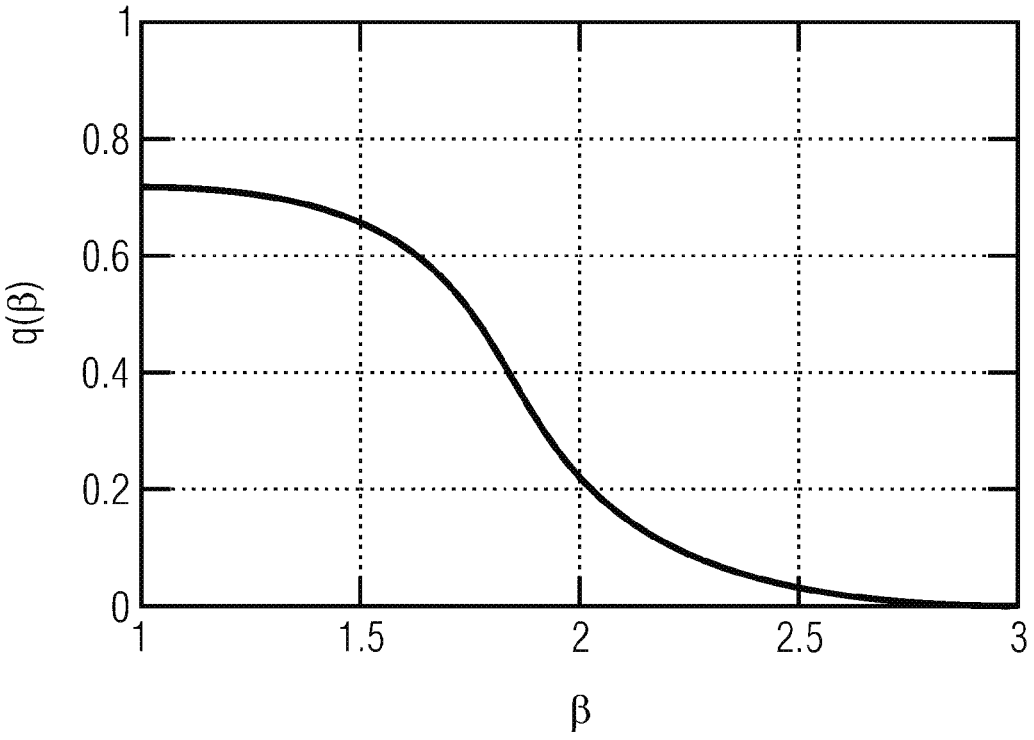
FIG. 8 shows a diffuse gain function according to an embodiment.

To mimic this effect, an embodiment may, for example, employ the gain function shown in FIG. 8. FIG. 8 illustrates an example of a diffuse gain function $q(\beta)$.

In other embodiments, the gain function is defined differently. The final diffuse sound $Y_{diff,i}(k, n)$ for the i-th loudspeaker channel is achieved by decorrelating $Y_{diff}(k, n)$, for example, according to formula (2b).

In the following, acoustic zoom based on DOAs and distances is considered.

According to some embodiments, the signal processor 105 may, e.g., be configured to receive distance information, wherein the signal processor 105 may, e.g., be configured to generate each audio output signal of the one or more audio output signals depending on the distance information.

Some embodiments employ a processing for the consistent acoustic zoom which is based on both the estimated DOA φ(k, n) and a distance value r(k, n). The concepts of these embodiments can also be applied to align the recorded acoustical scene to a video without zooming where the sources are not located at the same distance as previously assumed in the distance information r(k, n) available enables us to create an acoustical blurring effect for the sound sources which do not appear sharp in the visual image, e.g., for the sources which are not located on the focal plane of the camera.

To facilitate a consistent sound reproduction, e.g., an acoustical zoom, with blurring for sources located at different distances, the gains $G_i(k, n)$ and Q can be adjusted in formula (2a) as depicted in signal modifier 103 of FIG. 2 based on two estimated parameters, namely φ(k, n) and r(k, n), and depending on the zoom factor β. If no zooming is involved, β may be set to β=1.

The parameters φ(k, n) and r(k, n) may, for example, be estimated in the parameter estimation module 102 as described above. In this embodiment, the direct gain $G_i(k, n)$ is determined (for example by being selected in the gain selection unit 201) based on the DOA and distance information from one or more direct gain function gi,j(k, n) (which may, for example, be computed in the gain function computation module 104). Similarly as described for the embodiments above, the diffuse gain Q may, for example, be selected in the gain selection unit 202 from the diffuse gain function q(β), for example, computed in the gain function computation module 104 based on the zoom factor β.

In other embodiments, the direct gain $G_i(k, n)$ and the diffuse gain Q are computed by the signal modifier 103 without computing first the respective gain functions and then selecting the gains.

Figure 9:
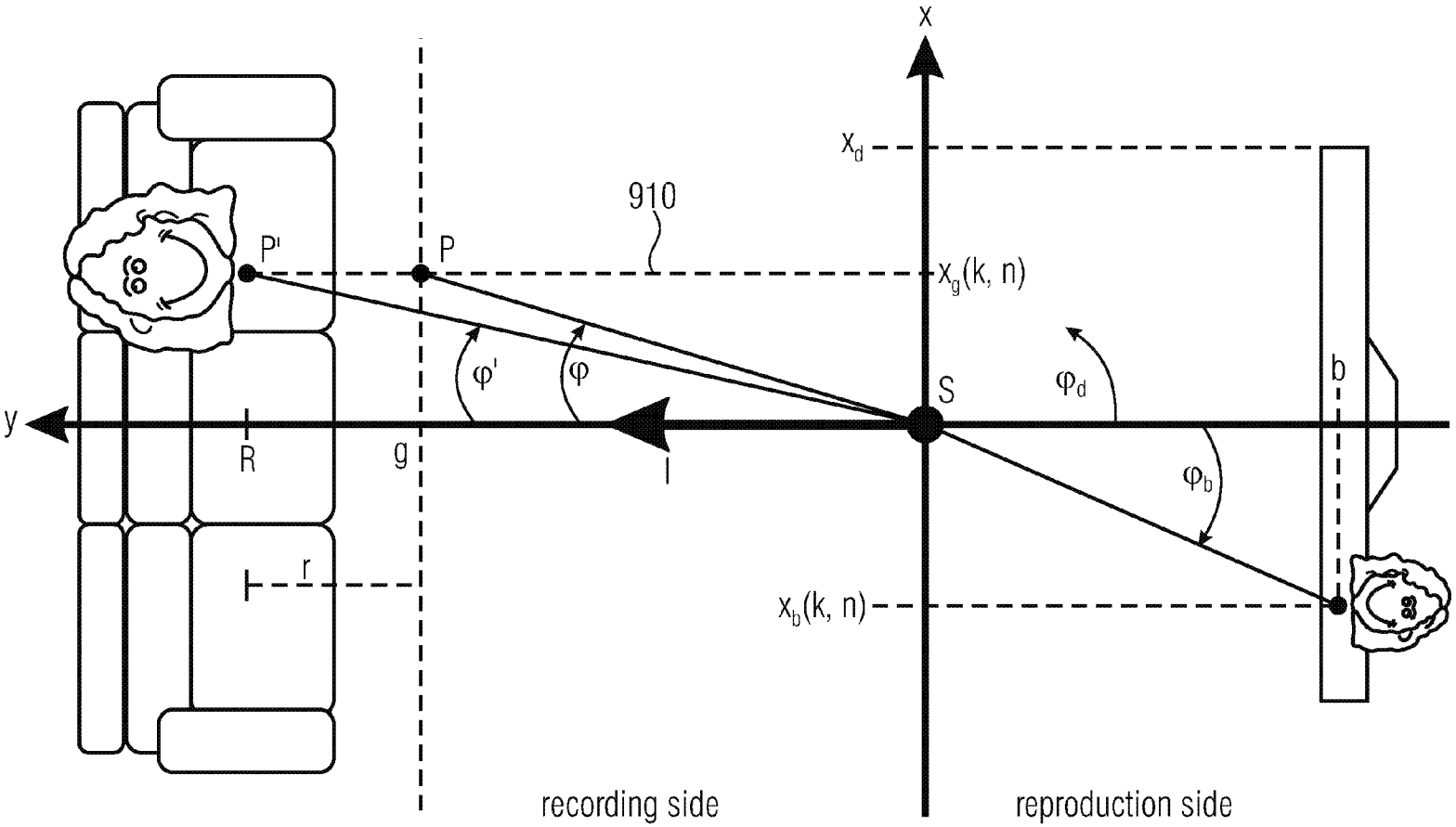
FIG. 9 depicts a second geometry for acoustic scene reproduction with acoustic zooming according to an embodiment, wherein a sound source is not located on a focal plane.

To explain the acoustic scene reproduction and acoustic zooming for sound sources at different distances, reference is made to FIG. 9. The parameters denoted in the FIG. 9 are analogous to those described above.

In FIG. 9, the sound source is located at position P' at distance R(k, n) to the x-axis. The distance r, which may, e.g., be (k, n)-specific (time-frequency-specific: r(k, n)) denotes the distance between the source position and focal plane (left vertical line passing through g). It should be noted that some autofocus systems are able to provide g, e.g., the distance to the focal plane.

The DOA of the direct sound from point of view of the microphone array is indicated by φ'(k, n). In contrast to other embodiments, it is not assumed that all sources are located at the same distance g from the camera lens. Thus, e.g., the position P' can have an arbitrary distance R(k, n) to the x-axis.

If the source is not located on the focal plane, the source will appear blurred in the video. Moreover, embodiments are based on the finding that if the source is located at any position on the dashed line 910, it will appear at the same position $x_b(k, n)$ in the video. However, embodiments are based on the finding that the estimated DOA φ'(k, n) of the direct sound will change if the source moves along the dashed line 910. In other words, based on the findings employed by embodiments, if the source moves parallel to the y-axis, the estimated DOA φ'(k, n) will vary while $x_b$ (and thus, the DOA $\varphi_b(k, n)$ from which the sound should be reproduced) remains the same. Consequently, if the estimated DOA φ'(k, n) is transmitted to the far-end side and used for the sound reproduction as described in the previous embodiments, then the acoustical and visual image are not aligned anymore if the source changes its distance R(k, n).

To compensate for this effect and to achieve a consistent sound reproduction, the DOA estimation, for example, conducted in the parameter estimation module 102, estimates the DOA of the direct sound as if the source was located on the focal plane at position P. This position represents the projection of P' on the focal plane. The corresponding DOA is denoted by φ(k, n) in FIG. 9 and is used at the far-end side for the consistent sound reproduction, similarly as in the previous embodiments. The (modified) DOA φ(k, n) can be computed from the estimated (original) DOA φ'(k, n) based on geometric considerations, if r and g are known.

For example, in FIG. 9, the signal processor 105 may, for example, calculate φ(k, n) from φ'(k, n) r and g according to:

$$\varphi = \arctan\left(\frac{\tan\varphi' \cdot (r+g)}{g}\right).$$

Thus, according to an embodiment, the signal processor 105 may, e.g., be configured to receive an original azimuth angle φ'(k, n) of the direction of arrival, being the direction of arrival of the direct signal components of the two or more audio input signals, and is configured to further receive distance information, and may, e.g., be configured to further receive distance information r. The signal processor 105 may, e.g., be configured to calculate a modified azimuth angle φ(k, n) of the direction of arrival depending on the azimuth angle of the original direction of arrival φ'(k, n) and depending on the distance information r and g. The signal processor 105 may, e.g., be configured to generate each audio output signal of the one or more of audio output signals depending on the azimuth angle of the modified direction of arrival φ(k, n).

The necessitated distance information can be estimated as explained above (the distance g of the focal plane can be obtained from the lens system or autofocus information). It should be noted that, for example, in this embodiment, the distance r(k, n) between the source and focal plane is transmitted to the far-end side together with the (mapped) DOA φ(k, n).

Moreover, by analogy to the visual zoom, the sources lying at a large distance r from the focal plane do not appear sharp in the image. This effect is well-known in optics as the so-called depth-of-field (DOF), which defines the range of source distances that appear acceptably sharp in the visual image.

Figure 10A:
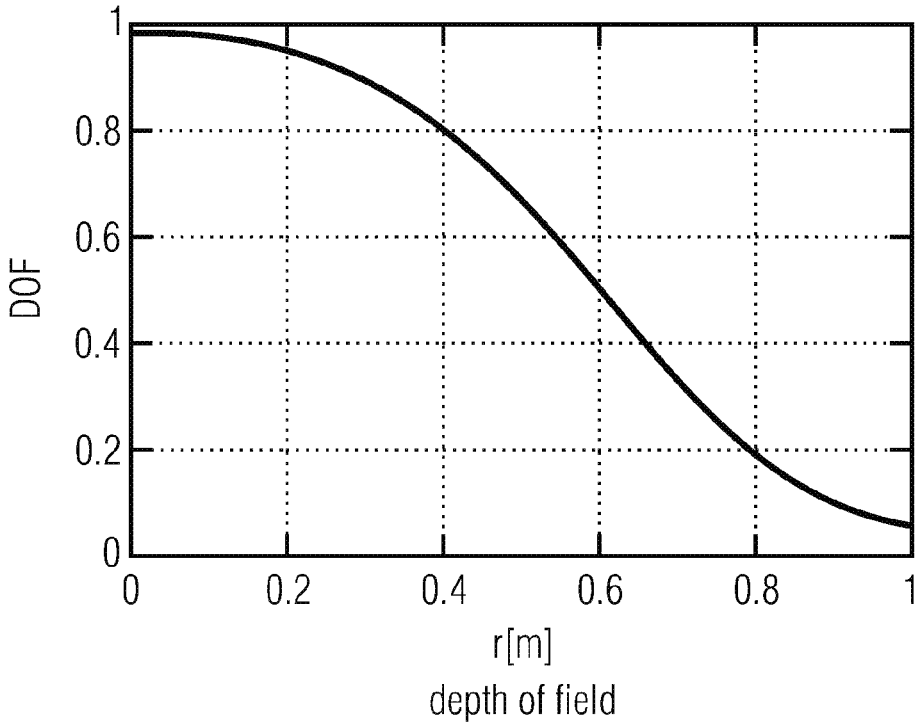
FIG. 10*a-c* illustrates functions to explain the direct sound blurring, and FIG. 11 visualizes hearing aids according to embodiments.
Figure 10B:
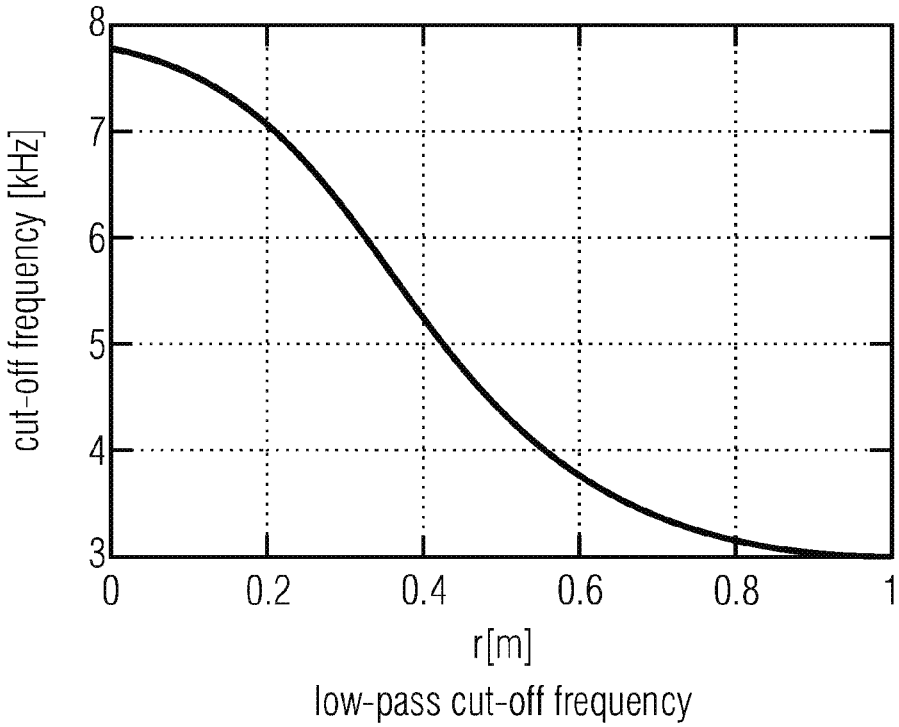
Figure 10C:
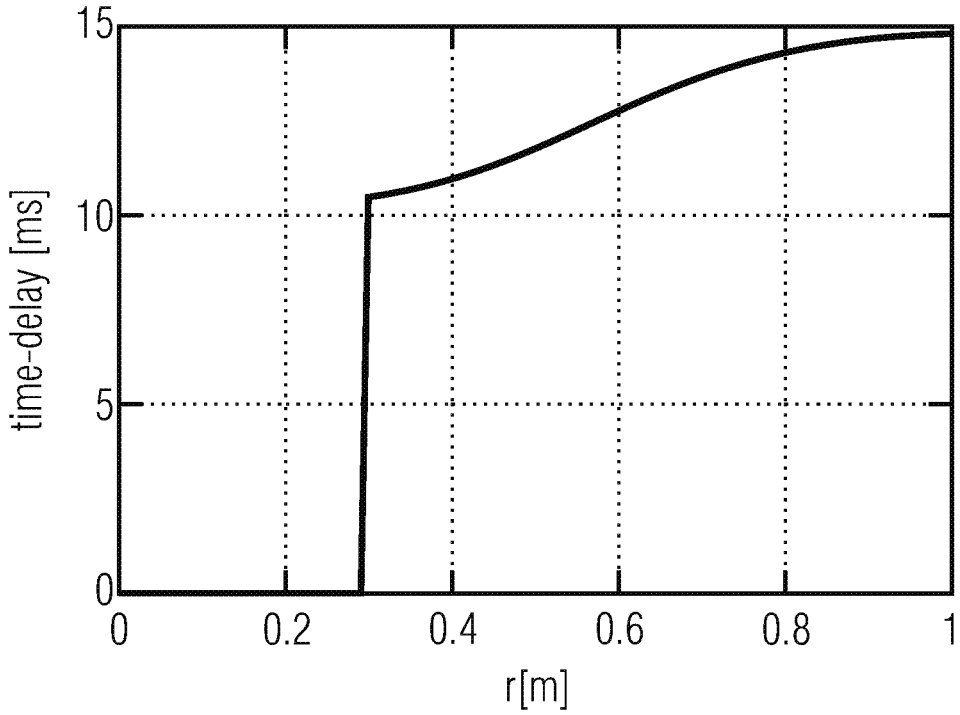

An example of the DOF curve as function of the distance r is depicted in FIG. 10(*a*).

FIG. 10 illustrates example figures for the depth-of-field (FIG. 10(*a*)), for a cut-off frequency of a low-pass filter (FIG. 10(*b*)), and for the time-delay in ms for the repeated direct sound (FIG. 10(*c*)).

In FIG. 10(*a*), the sources at a small distance from the focal plane are still sharp, whereas sources at larger distances (either closer or further away from the camera) appear as blurred. So according to an embodiment, the corresponding sound sources are blurred such that their visual and acoustical images are consistent.

To derive the gains $G_i(k, n)$ and Q in (2a), which realize the acoustic blurring and consistent spatial sound reproduction, the angle is considered at which the source positioned at P(φ, r) will appear on a display. The blurred source will be displayed at $$\tan \varphi_b(k,n) = \beta c \tan \varphi(k,n), \tag{30}$$

where c is the calibration parameter, β≥1 is the user-controlled zoom factor, φ(k, n) is the (mapped) DOA, for example, estimated in the parameter estimation module 102.

As mentioned before, the direct gain $G_i(k, n)$ in such embodiments may, e.g., be computed from multiple direct gain functions $g_{i,j}$. In particular, two gain functions $g_{i,1}(\varphi(k, n))$ and $g_{i,2}(r(k, n))$ may, for example, be used, wherein the first gain function depends on the DOA $\varphi(k, n)$, and wherein the second gain function depends on the distance $r(k, n)$. The direct gain $G_i(k, n)$ may be computed as:

$$G_i(k,n)=g_{i,1}(\varphi(k,n))g_{i,2}(r(k,n)) \tag{31}$$

$$g_{i,1}(\varphi)=p_{b,i}(\varphi)w_b(\varphi) \tag{32}$$

$$g_{i,2}(r)=b(r) \tag{33}$$

wherein $p_{b,i}(\varphi)$ denotes the panning gain function (to assure that the sound is reproduced from the right direction), wherein $w_b(\varphi)$ is the window gain function (to assure that the direct sound is attenuated if the source is not visible in the video), and wherein $b(r)$ is the blurring function (to blur sources acoustically if they are not located on the focal plane).

It should be noted that all gain functions can be defined frequency-dependent (which is omitted here for brevity). It should be further noted that in this embodiment the direct gain $G_i$ is found by selecting and multiplying gains from two different gain functions, as shown in formula (32).

Both gain functions $p_{b,i}(\varphi)$ and $w_b(\varphi)$ are defined analogously as described above. For example, they may be computed, e.g., in the gain function computation module 104, for example, using formulae (26) and (27), and they remain fixed unless the zoom factor $\beta$ changes. The detailed description of these two functions has been provided above. The blurring function $b(r)$ returns complex gains that cause blurring, e.g. perceptual spreading, of a source, and thus the overall gain function $g_i$ will also typically return a complex number. For simplicity, in the following, the blurring is denoted as a function of a distance to the focal plane $b(r)$.

The blurring effect can be obtained as a selected one or a combination of the following blurring effects: Low pass filtering, adding delayed direct sound, direct sound attenuation, temporal smoothing and/or DOA spreading. Thus, according to an embodiment, the signal processor 105 may, e.g., be configured to generate the one or more audio output signals by conducting low pass filtering, or by adding delayed direct sound, or by conducting direct sound attenuation, or by conducting temporal smoothing, or by conducting direction of arrival spreading.

Low pass filtering: In vision, a non-sharp visual image can be obtained by low-pass filtering, which effectively merges the neighboring pixels in the visual image. By analogy, an acoustic blurring effect can be obtained by low-pass filtering of the direct sound with the cut-off frequency selected based on the estimated distance of the source to the focal plane r. In this case, the blurring function $b(r, k)$ returns the low-pass filter gains for frequency k and distance r. An example curve for the cut-off frequency of a first-order low-pass filter for the sampling frequency of 16 kHz is shown in FIG. 10(*b*). For small distances r, the cut-off frequency is close to the Nyquist frequency, and thus almost no low-pass filtering is effectively performed. For larger distance values, the cut-off frequency is decreased until it levels off at 3 kHz where the acoustical image is sufficiently blurred.

Adding delayed direct sound: In order to unsharpen the acoustical image of a source, we can decorrelated the direct sound, for instance by repeating an attenuating the direct sound after some delay $\tau$ (e.g., between 1 and 30 ms). Such processing can, for example, be conducted according to the complex gain function of formula (34):

$$b(r;k)=1+\alpha(r)e^{-j\omega\tau(r)} \tag{34}$$

where $\alpha$ denotes the attenuation gain for the repeated sound and $\tau$ is the delay after which the direct sound is repeated. An example delay curve (in ms) is shown in FIG. 10(*c*). For small distances, the delayed signal is not repeated and $\alpha$ is set to zero. For larger distances, the time delay increases with increasing distance, which causes a perceptual spreading of an acoustic source.

Direct sound attenuation: The source can also be perceived as blurred when the direct sound is attenuated by a constant factor. In this case $b(r)=\text{const}<1$. As mentioned above, the blurring function $b(r)$ can consist of any of the mentioned blurring effects or as a combination of these effects. In addition, alternative processing that blurs the source can be used.

Temporal smoothing: Smoothing of the direct sound across time can, for example, be used to perceptually blur the acoustic source. This can be achieved by smoothing the envelop of the extracted direct signal over time.

DOA spreading: Another method to unsharpen an acoustical source consists in reproducing the source signal from the range of directions instead from the estimated direction only. This can be achieved by randomizing the angle, for example, by taking a random angle from a Gaussian distribution centered around the estimated $\varphi$. Increasing the variance of such a distribution, and thus the widening the possible DOA range, increases the perception of blurring.

Analogously as described above, computing the diffuse gain function $q(\beta)$ in the gain function computation module 104, may, in some embodiments, necessitate only the knowledge of the number of loudspeakers I available for reproduction. Thus the diffuse gain function $q(\beta)$ can, in such embodiments, be set as desired for the application. For example, for equally spaced loudspeakers, the real-valued diffuse sound gain $Q\epsilon[0, 1/\sqrt{I}]$ in formula (2a) is selected in the gain selection unit 202 based on the zoom parameter $\beta$. The aim of using the diffuse gain is to attenuate the diffuse sound depending on the zooming factor, e.g., zooming increases the DRR of the reproduced signal. This is achieved by lowering Q for larger $\beta$. In fact, zooming in means that the opening angle of the camera becomes smaller, e.g., a natural acoustical correspondence would be a more directive microphone which captures less diffuse sound. To mimic this effect, we can use for instance the gain function shown in FIG. 8. Clearly, the gain function could also be defined differently. Optionally, the final diffuse sound $Y_{diff,i}(k, n)$ for the i-th loudspeaker channel is obtained by decorrelating $Y_{diff}(k, n)$ obtained in formula (2b).

Figure 11:
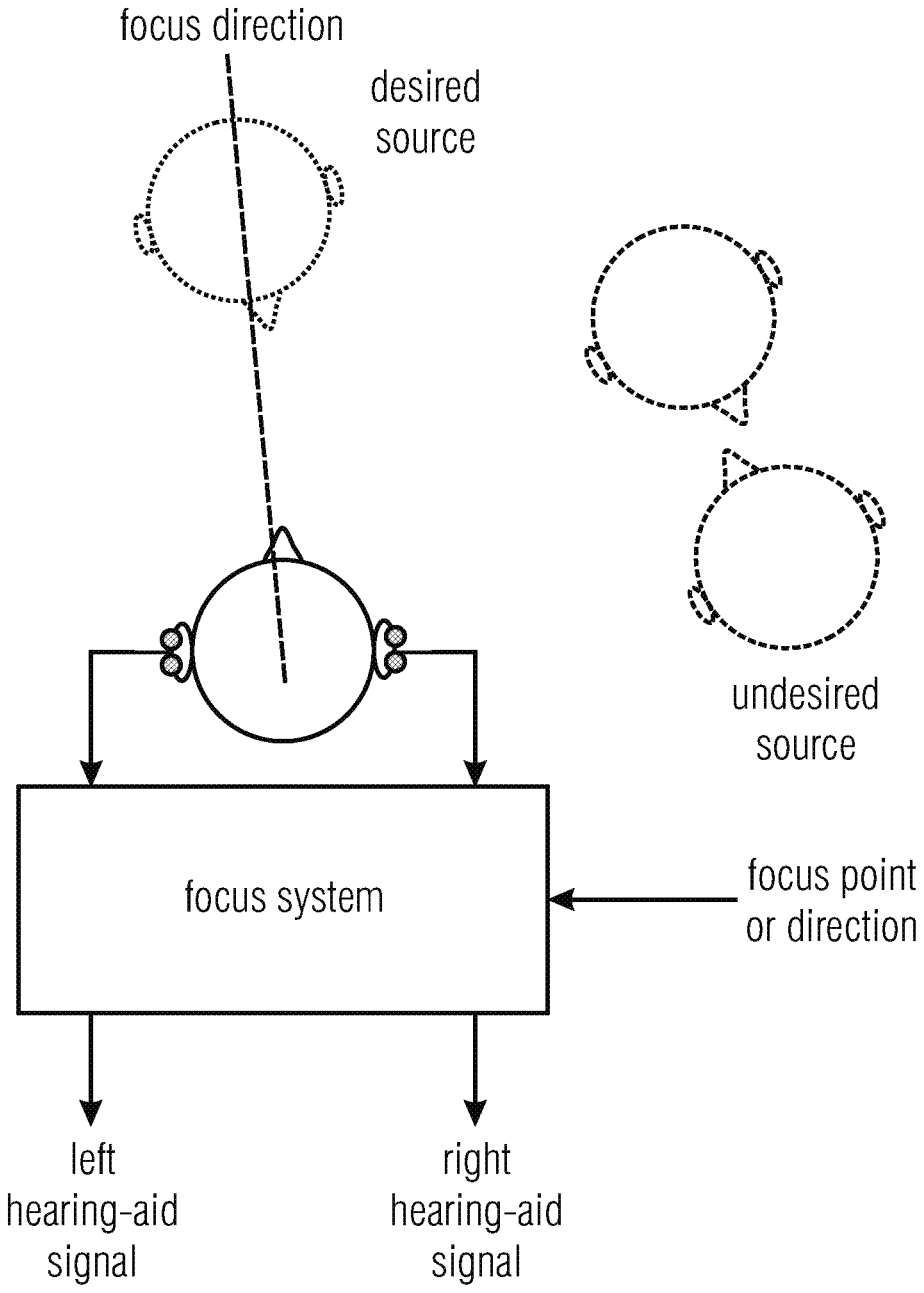

Now, embodiments are considered that realize an application to hearing aids and assistive listening devices. FIG. 11 illustrates such a hearing aid application.

Some embodiments are related to binaural hearing aids. In this case, it is assumed that each hearing aid is equipped with at least one microphone and that information can be exchanged between the two hearing aids. Due to some hearing loss, the hearing impaired person might experience difficulties focusing (e.g., concentrating on sounds coming from a particular point or direction) on a desired sound or sounds. In order to help the brain of the hearing impaired person to process the sounds that are reproduced by the hearing aids, the acoustical image is made consistent with the focus point or direction of the hearing aids user. It is conceivable that the focus point or direction is predefined, user defined, or defined by a brain-machine interface. Such embodiments ensure that desired sounds (which are assumed to arrive from the focus point or focus direction) and the undesired sounds appear spatially separated.

In such embodiments, the directions of the direct sounds can be estimated in different ways. According to an embodiment, the directions are determined based on the inter-aural level differences (ILDs) and/or inter-aural time differences (ITDs) that are determined using both hearing aids (see [15] and [16]).

According to other embodiments, the directions of the direct sounds on the left and right are estimated independently using a hearing aid that is equipped with at least two microphones (see [17]). The estimated directions can be fussed based on the sound pressure levels at the left and right hearing aid, or the spatial coherence at the left and right hearing aid. Because of the head shadowing effect, different estimators may be employed for different frequency bands (e.g., ILDs at high frequencies and ITDs at low frequencies).

In some embodiments, the direct and diffuse sound signals may, e.g., be estimated using the aforementioned informed spatial filtering techniques. In this case, the direct and diffuse sounds as received at the left and right hearing aid can be estimated separately (e.g., by changing the reference microphone), or the left and right output signals can be generated using a gain function for the left and right hearing aid output, respectively, in a similar way the different loudspeaker or headphone signals are obtained in the previous embodiments.

In order to spatially separate the desired and undesired sounds, the acoustic zoom explained in the aforementioned embodiments can be applied. In this case, the focus point or focus direction determines the zoom factor.

Thus, according to an embodiment, a hearing aid or an assistive listening device may be provided, wherein the hearing aid or an assistive listening device comprises a system as described above, wherein the signal processor 105 of the above-described system determines the direct gain for each of the one or more audio output signals, for example, depending on a focus direction or a focus point.

In an embodiment, the signal processor 105 of the above-described system may, e.g., be configured to receive zoom information. The signal processor 105 of the above-described system may, e.g., be configured to generate each audio output signal of the one or more audio output signals depending on a window gain function, wherein the window gain function depends on the zoom information. The same concepts as explained with reference to FIGS. 7(*a*), 7(*b*) and 7(*c*) are employed.

If a window function argument, depending on the focus direction or on the focus point, is greater than a lower threshold and smaller than an upper threshold, the window gain function is configured to return a window gain being greater than any window gain returned by the window gain function, if the window function argument is smaller than the lower threshold, or greater than the upper threshold.

For example, in case of the focus direction, focus direction may itself be the window function argument (and thus, the window function argument depends on the focus direction). In case of the focus position, a window function argument, may, e.g., be derived from the focus position.

Similarly, the invention can be applied to other wearable devices which include assistive listening devices or devices such as Google Glass®. It should be noted that some wearable devices are also equipped with one or more cameras or ToF sensor that can be used to estimate the distance of objects to the person wearing the device.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] Y. Ishigaki, M. Yamamoto, K. Totsuka, and N. Miyaji, "Zoom microphone," in Audio Engineering Society Convention 67, Paper 1713, October 1980.

[2] M. Matsumoto, H. Naono, H. Saitoh, K. Fujimura, and Y. Yasuno, "Stereo zoom microphone for consumer video cameras," Consumer Electronics, IEEE Transactions on, vol. 35, no. 4, pp. 759-766, November 1989. Aug. 13, 2014

[3] T. van Waterschoot, W. J. Tirry, and M. Moonen, "Acoustic zooming by multi microphone sound scene manipulation," J. Audio Eng. Soc, vol. 61, no. 7/8, pp. 489-507, 2013.

[4] V. Pulkki, "Spatial sound reproduction with directional audio coding," J. Audio Eng. Soc, vol. 55, no. 6, pp. 503-516, June 2007.

[5] R. Schultz-Amling, F. Kuech, O. Thiergart, and M. Kallinger, "Acoustical zooming based on a parametric sound field representation," in Audio Engineering Society Convention 128, Paper 8120, London UK, May 2010.

[6] O. Thiergart, G. Del Galdo, M. Taseska, and E. Habets, "Geometry-based spatial sound acquisition using distributed microphone arrays," Audio, Speech, and Language Processing, IEEE Transactions on, vol. 21, no. 12, pp. 2583-2594, December 2013.

[7] K. Kowalczyk, O. Thiergart, A. Craciun, and E. A. P. Habets, "Sound acquisition in noisy and reverberant environments using virtual microphones," in Applications of Signal Processing to Audio and Acoustics (WASPAA), 2013 IEEE Workshop on, October 2013.

[8] O. Thiergart and E. A. P. Habets, "An informed LCMV filter based on multiple instantaneous direction-of-arrival estimates," in Acoustics Speech and Signal Processing (ICASSP), 2013 IEEE International Conference on, 2013, pp. 659-663.

[9] O. Thiergart and E. A. P. Habets, "Extracting reverberant sound using a linearly constrained minimum variance spatial filter," Signal Processing Letters, IEEE, vol. 21, no. 5, pp. 630-634, May 2014.

[10] R. Roy and T. Kailath, "ESPRIT-estimation of signal parameters via rotational invariance techniques," Acoustics, Speech and Signal Processing, IEEE Transactions on, vol. 37, no. 7, pp. 984-995, July 1989.

[11] B. Rao and K. Hari, "Performance analysis of root-music," in Signals, Systems and Computers, 1988. Twenty-Second Asilomar Conference on, vol. 2,1988, pp. 578-582.

[12] H. Teutsch and G. Elko, "An adaptive close-talking microphone array," in Applications of Signal Processing to Audio and Acoustics, 2001 IEEE Workshop on the, 2001, pp. 163-166.

[13] 0. Thiergart, G. D. Galdo, and E. A. P. Habets, "On the spatial coherence in mixed sound fields and its application to signal-to-diffuse ratio estimation," The Journal of the Acoustical Society of America, vol. 132, no. 4, pp. 2337-2346, 2012.

[14] V. Pulkki, "Virtual sound source positioning using vector base amplitude panning," J. Audio Eng. Soc, vol. 45, no. 6, pp. 456-466, 1997.

[15] J. Blauert, Spatial hearing, 3rd ed. Hirzel-Verlag, 2001.

[16] T. May, S. van de Par, and A. Kohlrausch, "A probabilistic model for robust localization based on a binaural auditory front-end," IEEE Trans. Audio, Speech, Lang. Process., vol. 19, no. 1, pp. 1-13, 2011.

[17] J. Ahonen, V. Sivonen, and V. Pulkki, "Parametric spatial sound processing applied to bilateral hearing aids," in AES 45th International Conference, March 2012.

The invention claimed is:

1. An apparatus for generating one or more audio output signals, comprising:

a signal processor, and an output interface, wherein the signal processor is configured to receive a direct component signal, comprising direct signal components of two or more original audio signals, wherein the signal processor is configured to receive a diffuse component signal, comprising diffuse signal components of the two or more original audio signals, and wherein the signal processor is configured to receive direction information, said direction information depending on a direction of arrival of the direct signal components of the two or more original audio signals, wherein the signal processor is configured to generate one or more processed diffuse signals depending on the diffuse component signal, wherein, for each audio output signal of the one or more audio output signals, the signal processor is configured to determine, depending on the direction of arrival, a direct gain being a gain value, the signal processor is configured to apply said direct gain on the direct component signal to acquire a processed direct signal, and the signal processor is configured to combine said processed direct signal and one of the one or more processed diffuse signals to generate said audio output signal, and wherein the output interface is configured to output the one or more audio output signals, wherein the signal processor comprises a gain function computation module for calculating one or more gain functions, wherein each gain function of the one or more gain functions, comprises a plurality of gain function argument values, wherein a gain function return value is assigned to each of said gain function argument values, wherein, when said gain function receives one of said gain function argument values, said gain function is configured to return the gain function return value being assigned to said one of said gain function argument values, and wherein the signal processor further comprises a signal modifier for selecting, depending on the direction of arrival, a direction dependent argument value from the gain function argument values of a gain function of the one or more gain functions, for acquiring the gain function return value being assigned to said direction dependent argument value from said gain function, and for determining the gain value of at least one of the one or more audio output signals depending on said gain function return value acquired from said gain function.

2. A system for generating one or more audio output signals, comprising:

the apparatus according to claim 1, and a decomposition module, wherein the decomposition module is configured to receive two or more audio input signals being the two or more original audio signals, wherein the decomposition module is configured to generate the direct component signal, comprising the direct signal components of the two or more original audio signals, and wherein the decomposition module is configured to generate the diffuse component signal, comprising the diffuse signal components of the two or more original audio signals.

3. The system according to claim 2, wherein the gain function computation module is configured to generate a lookup table for each gain function of the one or more gain functions, wherein the lookup table comprises a plurality of entries, wherein each of the entries of the lookup table comprises one of the gain function argument values and the gain function return value being assigned to said gain function argument value, wherein the gain function computation module is configured to store the lookup table of each gain function in persistent or non-persistent memory, and wherein the signal modifier is configured to acquire the gain function return value being assigned to said direction dependent argument value by reading out said gain function return value from one of the one or more lookup tables being stored in the memory.

4. The system according to claim 2, wherein the signal processor is configured to determine two or more audio output signals, wherein the gain function computation module is configured to calculate two or more gain functions, wherein, for each audio output signal of the two or more audio output signals, the gain function computation module is configured to calculate a panning gain function being assigned to said audio output signal as one of the two or more gain functions, wherein the signal modifier is configured to generate said audio output signal depending on said panning gain function.

5. The system according to claim 4, wherein the panning gain function of each of the two or more audio output signals comprises one or more global maxima, being one of the gain function argument values of said panning gain function, wherein for each of the one or more global maxima of said panning gain function, no other gain function argument value exists for which said panning gain function returns a greater gain function return value than for said global maxima, and wherein, for each pair of a first audio output signal and a second audio output signal of the two or more audio output signals, at least one of the one or more global maxima of the panning gain function of the first audio output signal is different from any of the one or more global maxima of the panning gain function of the second audio output signal.

6. The system according to claim 4, wherein, for each audio output signal of the two or more audio output signals, the gain function computation module is configured to calculate a window gain function being assigned to said audio output signal as one of the two or more gain functions, wherein the signal modifier is configured to generate said audio output signal depending on said window gain function, and wherein, if an argument value of said window gain function is greater than a lower window threshold and smaller than an upper window threshold, the window gain function is configured to return a gain function return value being greater than any gain function return value returned by said window gain function, if a window function argument value is smaller than the lower threshold, or greater than the upper threshold.

7. The system according to claim 6, wherein the window gain function of each of the two or more audio output signals comprises one or more global maxima, being one of the gain function argument values of said window gain function, wherein for each of the one or more global maxima of said window gain function, no other gain function argument value exists for which said window gain function returns a greater gain function return value than for said global maxima, and wherein, for each pair of a first audio output signal and a second audio output signal of the two or more audio output signals, at least one of the one or more global maxima of the window gain function of the first audio output signal is equal to one of the one or more global maxima of the window gain function of the second audio output signal.

8. The system according to claim 6, wherein the gain function computation module is configured to further receive orientation information indicating an angular shift of a look direction with respect to the direction of arrival, and wherein the gain function computation module is configured to generate the panning gain function of each of the audio output signals depending on the orientation information.

9. The system according to claim 8, wherein the gain function computation module is configured to generate the window gain function of each of the audio output signals depending on the orientation information.

10. The system according to claim 6, wherein the gain function computation module is configured to further receive zoom information, wherein the zoom information indicates an opening angle of a camera, and wherein the gain function computation module is configured to generate the panning gain function of each of the audio output signals depending on the zoom information.

11. The system according to claim 10, wherein the gain function computation module is configured to generate the window gain function of each of the audio output signals depending on the zoom information.

12. The system according to claim 6, wherein the gain function computation module is configured to further receive a calibration parameter for aligning a visual image and an acoustical image, and wherein the gain function computation module is configured to generate the panning gain function of each of the audio output signals depending on the calibration parameter.

13. The system according to claim 12, wherein the gain function computation module is configured to generate the window gain function of each of the audio output signals depending on the calibration parameter.

14. The system according to claim 2, wherein the gain function computation module is configured to receive information on a visual image, and wherein the gain function computation module is configured to generate, depending on the information on a visual image, a blurring function returning complex gains to realize perceptual spreading of a sound source.

15. A method for generating one or more audio output signals, comprising:

receiving a direct component signal, comprising direct signal components of two or more original audio signals, receiving a diffuse component signal, comprising diffuse signal components of the two or more original audio signals, receiving direction information, said direction information depending on a direction of arrival of the direct signal components of the two or more original audio signals, generating one or more processed diffuse signals depending on the diffuse component signal, for each audio output signal of the one or more audio output signals, determining, depending on the direction of arrival, a direct gain, applying said direct gain on the direct component signal to acquire a processed direct signal, and the combining said processed direct signal and one of the one or more processed diffuse signals to generate said audio output signal, and outputting the one or more audio output signals, wherein generating the one or more audio output signals comprises calculating one or more gain functions, wherein each gain function of the one or more gain functions, comprises a plurality of gain function argument values, wherein a gain function return value is assigned to each of said gain function argument values, wherein, when said gain function receives one of said gain function argument values, wherein said gain function is configured to return the gain function return value being assigned to said one of said gain function argument values, and wherein generating the one or more audio output signals comprises selecting, depending on the direction of arrival, a direction dependent argument value from the gain function argument values of a gain function of the one or more gain functions, for acquiring the gain function return value being assigned to said direction dependent argument value from said gain function, and for determining the gain value of at least one of the one or more audio output signals depending on said gain function return value acquired from said gain function.

16. The method according to claim 15, wherein the method further comprises:

receiving two or more audio input signals being the two or more original audio signals, generating the direct component signal, comprising the direct signal components of the two or more original audio signals and, generating a diffuse component signal, comprising the diffuse signal components of the two or more original audio signals.

17. A non-transitory digital storage medium having stored thereon a computer program for performing a method for generating one or more audio output signals, comprising:

receiving a direct component signal, comprising direct signal components of two or more original audio signals, receiving a diffuse component signal, comprising diffuse signal components of the two or more original audio signals, receiving direction information, said direction information depending on a direction of arrival of the direct signal components of the two or more original audio signals, generating one or more processed diffuse signals depending on the diffuse component signal, for each audio output signal of the one or more audio output signals, determining, depending on the direction of arrival, a direct gain, applying said direct gain on the direct component signal to acquire a processed direct signal, and the combining said processed direct signal and one of the one or more processed diffuse signals to generate said audio output signal, and outputting the one or more audio output signals, wherein generating the one or more audio output signals comprises calculating one or more gain functions, wherein each gain function of the one or more gain functions, comprises a plurality of gain function argument values, wherein a gain function return value is assigned to each of said gain function argument values, wherein, when said gain function receives one of said gain function argument values, wherein said gain function is configured to return the gain function return value being assigned to said one of said gain function argument values, and wherein generating the one or more audio output signals comprises selecting, depending on the direction of arrival, a direction dependent argument value from the gain function argument values of a gain function of the one or more gain functions, for acquiring the gain function return value being assigned to said direction dependent argument value from said gain function, and for determining the gain value of at least one of the one or more audio output signals depending on said gain function return value acquired from said gain function, when said computer program is run by a computer.

* * * * *